US006670745B2

(12) United States Patent
Carpinelli et al.

(10) Patent No.: US 6,670,745 B2
(45) Date of Patent: Dec. 30, 2003

(54) CATHODE RAY TUBE DEFLECTION YOKE

(75) Inventors: Joseph Michael Carpinelli, Lawrenceville, NJ (US); Michael Denton Grote, Hamilton, NJ (US); John Richard Fields, Princeton Junction, NJ (US)

(73) Assignees: Sarnoff Corporation, Princeton, NJ (US); Orion Electric Company, LTD, Kyung-Bukm (KR)

( * ) Notice: Subject to any disclaimer, the term of this patent is extended or adjusted under 35 U.S.C. 154(b) by 0 days.

(21) Appl. No.: 10/104,752

(22) Filed: Mar. 22, 2002

(65) Prior Publication Data

US 2003/0038580 A1 Feb. 27, 2003

Related U.S. Application Data

(60) Provisional application No. 60/279,006, filed on Mar. 27, 2001, and provisional application No. 60/279,573, filed on Mar. 29, 2001.

(51) Int. Cl.[7] ..... H01J 29/70; H01H 1/00

(52) U.S. Cl. ..... 313/440; 335/210; 335/213

(58) Field of Search ..... 313/440, 442, 313/422, 426, 428, 412, 413, 414, 415; 335/210, 213; H01J 29/70; H01H 1/00

(56) References Cited

U.S. PATENT DOCUMENTS 4,228,413 A * 10/1980 Campbell et al. ..... 335/213
4,937,931 A 7/1990 Jacobs et al.
5,077,533 A 12/1991 Klingelhofer
5,121,028 A 6/1992 Milili
5,204,649 A 4/1993 Togane et al.
5,302,927 A 4/1994 Fourche et al.

(List continued on next page.)

FOREIGN PATENT DOCUMENTS

GB 2 058 446 A * 4/1981 ..... H01J/29/51

OTHER PUBLICATIONS

F. Klingelhofer, "A Self–Converging NS Pincushion Distortion–Free Deflection Yoke for 19–In. Flat–Face PIL CRT", Paper 45.4, SID 92 Digest, 1992, pp. 889–891.

(List continued on next page.)

*Primary Examiner*—Don Wong
*Assistant Examiner*—Trinh Vo Dinh
(74) *Attorney, Agent, or Firm*—William J. Burke

(57) ABSTRACT

A cathode ray tube deflection yoke is provided wherein the deflection yoke includes a plurality of deflection coils. One or more of the deflection coils have a non-constant distribution of turns, whereby an electron beam passing through the deflection yoke is deflected by a magnetic field that varies according to different numbers of turns relative to position of electrons of the electron beam between the entrance and exit of the deflection yoke. The non-constant turns distribution may be linear or non-linear, may be monotonic or non-monotonic, and/or may have a positive or negative turns bias, either in whole or in part. The horizontal deflection coil and/or the vertical deflection coil, or both, may have a non-constant turns distribution.

17 Claims, 15 Drawing Sheets

U.S. PATENT DOCUMENTS

| | | | | | |
|---|---|---|---|---|---|
| 5,408,159 | A | * | 4/1995 | Maillot et al. | 313/440 |
| 5,418,422 | A | | 5/1995 | Vink et al. | |
| 5,455,483 | A | * | 10/1995 | Azzi et al. | 313/440 |
| 5,506,469 | A | | 4/1996 | Vink et al. | |
| 5,719,476 | A | * | 2/1998 | Grote | 315/370 |
| 5,841,226 | A | | 11/1998 | Hichiwa et al. | |
| 5,900,693 | A | * | 5/1999 | Azzi et al. | 313/440 |
| 5,942,845 | A | | 8/1999 | Matsubara | |
| 6,084,490 | A | | 7/2000 | Azzi et al. | |
| 6,150,910 | A | | 11/2000 | Azzi et al. | |
| 6,351,200 | B1 | | 2/2002 | Azzi et al. | |

OTHER PUBLICATIONS

M. Honda et al, "Development of Yoke for "Pure Flat" 17in. CRT", Paper 29.1, SID 96 Digest, 1996, pp. 709–712.

A Kato, "Development of 41–cm (17–in.) Short–Length Color Monitor Tube", Paper 11.2, SID 97 Digest, 1997, pp. 138–141.

B. B. Dasgupta, "19.1: Invited Paper: Recent Advances in Deflection Yoke Design", Society For Information Display International Symposium Digest Of Technical Papers, San Jose, California, May 1999, pp. 248–253.

B. B. Dasgupta, "Deflection and Convergence Technology", Society For Information Display Seminar Lecture Notes, Seminar M–4, vol. 1, May 1991, pp. M–4/1 to M–4/43.

* cited by examiner

CATHODE RAY TUBE DEFLECTION YOKE

This Application claims the benefit of U.S. Provisional Application Serial No. 60/279,006 filed Mar. 27, 2001, and U.S. Provisional Application Serial No. 60/279,573 filed Mar. 29, 2001.

The present invention relates to a deflection yoke for a cathode ray tube and, in particular, to a deflection yoke including a coil having a non-constant distribution of turns.

A deflection yoke for a cathode ray tube (CRT) includes a shaped horizontal coil for deflecting the beam or beams of electrons produced by an electron gun in a horizontal direction across the CRT faceplate (screen) and a shaped vertical coil for deflecting the beam(s) of electrons across the screen in a vertical direction. Typically, many horizontal scans are accomplished at a relatively high horizontal scan rate within each cycle of the relatively low frequency vertical scan rate. The horizontal and vertical deflection coils are usually shaped so as to lie in a generally conforming manner close to and generally surrounding the funnel-shaped glass envelope of the CRT proximate a tube neck that contains the electron gun. The deflection yoke usually has a shaped core of ferromagnetic material, such as a ferrite material, for more effectively concentrating the magnetic field produced by the horizontal and vertical coils in the interior of the tube envelope in a deflection region thereof for deflecting the electron beam(s) in the horizontal and vertical directions.

The inherent problem of deflection yokes is the significant inductance exhibited by the coils in combination with the ferrite core, particularly for the horizontal coil due to its operation at a higher horizontal scan rate or frequency. Such inductance dictates the amount of energy that must be stored in the magnetic field to produce a particular magnetic field strength in the deflection region of the CRT. A measure of the energy stored in the magnetic field produced by the horizontal coil is referred to as the "horizontal stored energy" or "HSE" and is a useful relative measure or parameter for comparing the relative efficiency of different deflection yokes. HSE is a value in milli-Joules (mJ) calculated by $HSE=\frac{1}{2} L(I_p)^2$ where L is the inductance of the deflection coil in milli-Henries and $I_p$ is the peak deflection current in amperes.

As certain desirable features of a CRT are pursued, e.g., a "short" or "slim" CRT having reduced depth between the CRT faceplate and the far end of the tube neck, greater deflection angles are desired which increases the strength of the magnetic deflection field required. Newer wider CRTs, such as the 16:9 aspect ratio CRTs employed in high-definition television (HDTV) displays, tend also to increase the required deflection angle and the strength of the deflection field required. The foregoing tends to increase the required coil size and/or number of turns and/or drive current magnitude, all of which tend to increase the HSE of the deflection yoke.

Practical considerations, such as heat generation, temperature rise, and the cost of the deflection yoke and of the circuitry employed to apply suitable drive currents thereto, serve to limit the maximum energy stored in the magnetic field to about 7–8 mJ. Conventional deflection yokes employ deflection coils having a "uniform" or "constant" turns distribution, i.e. the number of turns producing the magnetic deflection field is substantially the same over a majority of the entire Z-axis length of the yoke, except for relatively small regions at the yoke entrance and yoke exit where the number of turns changes rapidly from zero to the constant number of turns, and for small numbers of correction turns or correction coils for correcting coma, convergence, distortion and the like. Conventional deflection yokes tend to exhibit undesirably high HSE values for deflecting newer wide deflection angle CRTs.

While certain prior art deflection yokes have employed deflection coils wherein the coils have certain turns arranged for correcting convergence, pincushion distortion and/or other errors, all known prior art deflection yokes employ deflection coils wherein the magnetic field produced by essentially all of the turns thereof affect the electron beams over the entire deflection length of the yoke, although a few turns may be used for certain corrections. Examples include U.S. Pat. Nos. 5,121,028, 5,418,422, and 5,506,469 (e.g., gun-side end turns for correction of mis-convergence, coma errors, astigmatism, north-south raster errors), U.S. Patent 5,077,533 (e.g., screen end turns for modification of third and higher harmonics), and U.S. Pat. Nos. 5,077,533, 5,121,028, 5,418,422 (e.g., side turns for harmonic correction).

It would be desirable to provide greater deflection without increasing the deflection power (or HSE) or to reduce the deflection power (or HSE) required to produce a given deflection, or some combination thereof.

Accordingly, there is a need for an improved deflection yoke and CRT.

To this end, the deflection yoke of the present invention has an exit region between an entrance region and a yoke exit, wherein the exit region is substantially longer than the entrance region, and comprises first and second deflection coils, wherein at least one of the first and second deflection coils has a non-constant distribution of turns in the exit region between the entrance region and the yoke exit of the deflection yoke. A magnetic core is disposed for cooperating with the first and second deflection coils to form a deflection yoke.

According to another aspect, a cathode ray tube comprises a tube envelope, an electron gun providing an electron beam impinging on a screen, and a deflection yoke according to the previous paragraph positioned proximate the tube envelope for scanning deflection of the electron beam produced by the electron gun on the screen.

BRIEF DESCRIPTION OF THE DRAWING

The detailed description of the preferred embodiments of the present invention will be more easily and better understood when read in conjunction with the FIGURES of the Drawing which include.

Figure 1:
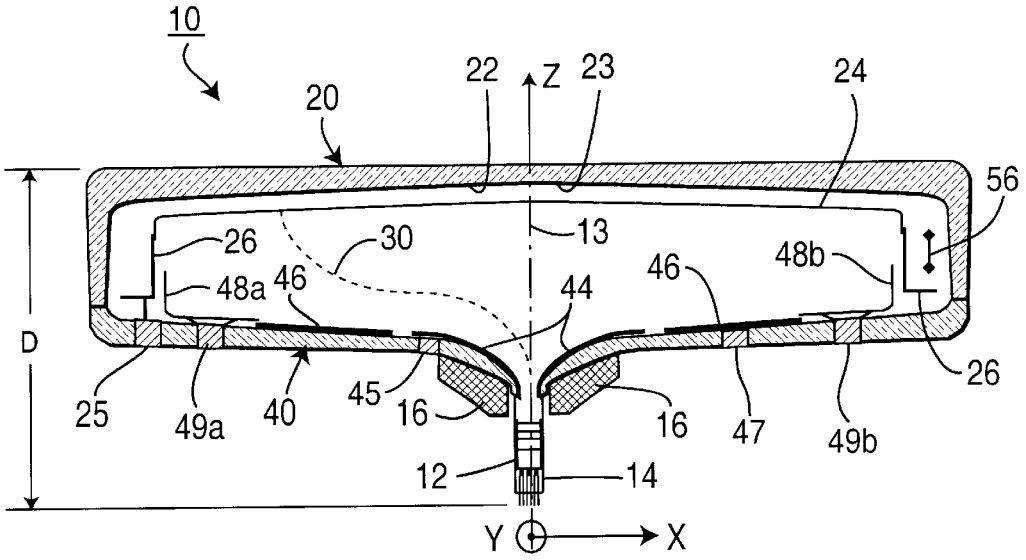
FIG. 1 is a cross-sectional schematic diagram of an example embodiment of a cathode ray tube.

In the Drawing, where an element or feature is shown in more than one drawing figure, the same alphanumeric designation may be used to designate such element or feature in each figure, and where a closely related or modified element is shown in a figure, the same alphanumerical designation primed may be used to designate the modified element or feature. Similarly, similar elements or features may be designated by like alphanumeric designations in different figures of the Drawing and with similar nomenclature in the specification, but in the Drawing are preceded by digits unique to the embodiment described. For example, a particular element may be designated as "xx" in one figure, by "1xx" in another figure, by "2xx" in another figure, and so on. According to common practice, the various features of the drawing are not to scale, and the dimensions of the various features are arbitrarily expanded or reduced for clarity.

DESCRIPTION OF THE PREFERRED EMBODIMENT(S)

A cathode ray tube deflection yoke is provided wherein the deflection yoke includes a plurality of deflection coils. One or more of the deflection coils have a non-constant" or "non-uniform" distribution of turns, whereby an electron beam passing through the deflection yoke is deflected by a magnetic field that varies according to different numbers of turns in relation to position between the entrance and exit of the deflection yoke.

The end of the deflection yoke closest to the electron gun is generally referred to as the entrance or yoke entrance or entrance plane, because that is where the electron beam(s) enter the magnetic deflection field produced by the deflection yoke. The end of the deflection yoke closest to the CRT faceplate or screen is generally referred to as the exit or yoke exit or exit plane, because that is where the electron beam(s) leave the magnetic deflection field produced by the deflection yoke. Owing to the funnel-shape of the CRT glass envelope, the deflection yoke is also typically more or less funnel-shaped with the narrower central opening at its entrance and the larger central opening at its exit.

The central axis (usually referred to as the Z-axis) of the CRT is generally (due to symmetry) also the central axis of the electron gun, the deflection yoke and the glass funnel, and generally intersects the faceplate, which lies generally (ignoring curvature, if any) in the X-Y plane, at its center. The horizontal direction is usually considered as the X direction and the vertical direction as the Y direction.

In a cathode ray tube, the electrons of the electron beam(s) may be further deflected after leaving the influence of the magnetic deflection yoke, i.e. in what is referred to as the "drift region" or "field-free region" of a conventional CRT through which the electrons travel in substantially straight lines to the screen. In a conventional CRT, the electrons are at the screen or anode potential at the time they leave the gun and deflection regions and, not being under the influence of any electric or magnetic field, travel in straight lines to the screen or faceplate thereof. Such cathode ray tube may find application, for example, in television displays, computer displays, projection tubes and other applications where it is desired to provide a visual display.

FIG. 1 is a cross-sectional diagram of a cathode ray tube 10. It is noted that unless otherwise specified, such cross-sectional diagrams may be considered to illustrate either the horizontal or the vertical deflection orientation because both appear similar in such diagrams. FIG. 1 illustrates a horizontal, i.e. X-Z plane, cross section. Electrons produced by electron gun 12 located in tube neck 14 are directed towards faceplate 20, which includes a screen or anode electrode 22 biased at a relatively high positive potential, and are deflected by magnetic fields produced by deflection yoke 16 to scan across faceplate 20. Electrodes 44, 46, 48 on tube envelope 40 are biased to predetermined potentials to establish electrostatic fields within tube envelope 40, and may be biased to provide a field-free region or to deflect electron beams 30 either away from the tube 10 centerline further than they are deflected by the magnetic field produced by deflection yoke 16 or towards screen 22, or both. Electrode 44 may be referred to as a neck electrode because it is proximate neck 14 and electrodes 46, 48 may be referred to as funnel electrodes because they are disposed along the funnel portions of tube envelope 40.

A coating of phosphorescent material 23 is disposed on faceplate 20 for producing light in response to the beam of electrons 30 impinging thereon, thereby providing a monochromatic display, or a pattern of different phosphorescent materials 23 is disposed thereon for producing different colors of light in response to the plural beams of electron beam 30 impinging thereon through apertures in shadow mask 24, thereby providing a color display. Usually, the three beams of electron beam 30 are referred to as the "red R beam," the "green G beam," and the "blue B beam" indicating the beams that are intended to illuminate the red phosphor, the green phosphor and the blue phosphor, respectively, of phosphor 23.

Electrostatic fields may be established within tube 10 by a number of conductive electrodes located on or close to backplate 40 and biased at respective positive potentials, i.e. at potentials of like polarity to that of the screen or anode electrode 22. The bias potentials on electrodes 44, 46, 48 of tube 10 provide an electrostatic field to control and/or affect the trajectories of the electrons of electron beam 30, and may thereby reduce the required distance between the faceplate 20 and electron gun 12 of example tube 10, and/or change the landing angle of electron beam 30 on screen 22.

Electrode 44 surrounds the outlet of gun 12 in the vicinity of neck 14 and is biased at a positive potential that is preferably equal to or less than the potential at screen electrode 22. The electrostatic field produced by electrode 44 being biased below screen potential may result in the electrons of electron beam 30 being slower moving proximate yoke 16, and therefore more easily deflected. Such cooperation between electrode 44 and yoke 16 may be utilized to realize either a reduction of yoke power, and therefore a smaller, lighter, less expensive and likely more reliable deflection yoke 16, or a greater deflection angle with the same yoke power and yoke.

Electrode 46 also surrounds the outlet of gun 12, but is spaced away from neck 14 towards screen 22, and is biased at a positive potential that is preferably equal to or greater than the potential at screen electrode 22. Where electrode 46 is biased above screen 22 potential, the electrostatic field produced thereby may be utilized to cause the electrons of beam 30 to travel in a path that bends their trajectories away from faceplate 20, thereby increasing the deflection angle from that produced by magnetic deflection yoke 16 alone, and also decreasing the "landing angle" of electron beam 30. Electrode 46 is desirably positioned so that its electrostatic field does not act on electron beam 30 until after it has been substantially fully acted upon by deflection yoke 16.

"Landing angle" is the angle with respect to the plane of the screen at which electron beam 30 impinges upon screen electrode 22, and in a color CRT, the shadow mask 24 proximate thereto. As a result of the action of the field of electrode 46, the landing angle may become smaller as the distance from the central or Z axis of tube 10 becomes greater and/or as the deflection angle of electron beam 30 increases. Because shadow mask 24 has a non-zero thickness, if the landing angle is too small, e.g., less than about 25°, too many of the electrons will hit the sides of the apertures in shadow mask 24 instead of passing therethrough, thereby reducing the intensity of the electron beam reaching phosphor 23 on the faceplate 20 and of the light produced thereby.

Advantageously, electrode 48 is located distal the central or Z axis of tube 10 and near the periphery of faceplate 20 where the landing angle is smallest. Electrode 48 surrounds the outlet of gun 12, at least with respect to the horizontal deflection which is typically greater than the vertical deflection. Electrode 48 is substantially at the periphery of backplate 40, and is biased at a positive potential that is preferably equal to or less than the potential at screen electrode 22. When electrode 48 is biased at a potential below screen 22 potential, the field therefrom acts to direct electron beams 30 back towards faceplate 20 for increasing the landing angle thereof near the periphery of faceplate 20. Electrode 48 may be biased to a potential less than the potential at neck electrode 44 where desired to provide greater reduction of landing angle. Thus, the electrostatic fields created by electrodes 46 and 48 may complement each other in that when electrode 46 increases the deflection angle (which decreases the landing angle at the periphery of faceplate 20), electrode 48, which has its strongest effect near the periphery of faceplate 20, may act to increase the landing angle in the region where it might otherwise be undesirably small.

Figure 2:
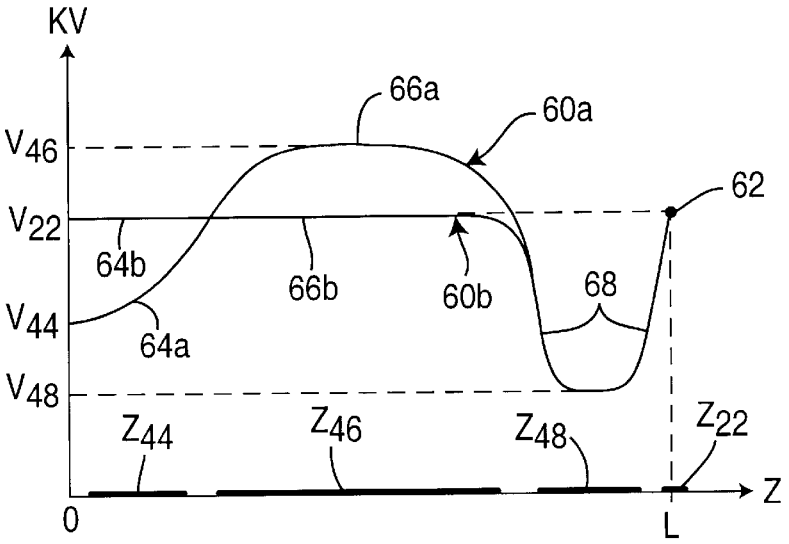
FIG. 2 is a graphical representation of the potential in the cathode ray tube of FIG. 1.

The relationship and effects of the electrostatic fields described above cooperate in a tube 10 that may be shorter in depth than a conventional CRT and yet may operate at a comparable and/or reasonable deflection yoke power level. Two example potential distributions over the depth of tube 10 along its Z axis are illustrated in FIG. 2. Potential characteristics 60*a*, 60*b* illustrate two different biasing potential characteristics and are plotted on a graph having distance from the exit of gun 12 along the ordinate and bias potential in kilovolts along the abscissa. Screen electrode 22 located at a distance L from gun 12 and represented by region $Z_{22}$ is biased at a relatively high positive potential $V_{22}$ represented at point 62. In order from gun 12 at Z=0 are neck electrode 44 located proximate gun 12 and represented by electrode region $Z_{44}$ that is biased at a positive potential $V_{44}$, electrode 46 located intermediate gun 12 and faceplate 20 and represented by electrode region $Z_{46}$ that is biased at a relatively high positive potential $V_{46}$ that is preferably equal to or higher than the screen potential $V_{22}$, and electrode 48 located more proximate to faceplate 20 and represented by electrode region $Z_{48}$ that is biased at a positive potential $V_{48}$ that is preferably lower than screen potential $V_{22}$ (but could be equal thereto) and could preferably be lower than gun potential $V_{44}$.

Electrodes 44, 46, 48, 22 and bias potentials $V_{44}$, $V_{46}$, $V_{48}$, $V_{22}$ thereon produce potential characteristic 60*a* that has a portion 64*a* rising towards the screen potential $V_{22}$ thereby tending to slow the acceleration of electrons towards faceplate 20 to provide additional flight time during which the subsequent electrostatic fields act upon the electrons. Characteristic 60*a* has a portion 66*a* in which the potential peaks at a level relatively higher than the screen potential $V_{22}$ thereby to cause the electrons to move along trajectories that depart further from central axis Z of tube 10 to increase the deflection angle and a portion 68*a* in which the potential bottoms at a level lower than the screen potential $V_{22}$ and the gun potential $V_{44}$ thereby to cause the electrons to move along trajectories that turn toward faceplate 20 of tube 10 to increase the landing angle of electron beam 30 near the edges of screen 22.

It is noted that the location of the gap between electrodes 44 and 46 may strongly affect the operation of tube 10. If electrode 46 having a relatively very high positive potential bias extends too close to the exit of gun 12 (and/or neck electrode 44 does not extend sufficiently far therefrom), then the electrons emitted from gun 12 are accelerated and additional magnetic deflection effort is required of deflection yoke 16 (e.g., additional yoke power, field and/or size) to provide the desired magnetic deflection. On the other hand, if neck electrode 44 extends too far beyond the exit of gun 12, then the electrons spend too much time in a region in which electrostatic forces act counter to the deflection sought to be produced by magnetic deflection yoke 16, thereby increasing the power, field and /or size required of yoke 16 to deflect the electron to the corners of faceplate 20, even with the beneficial effect of electrode 46.

Alternatively, electrodes 44 and 46 may be biased to screen potential $V_{22}$ where deflection yoke 16 provides greater deflection, e.g., 135–140° deflection, as illustrated by segments 64*b*, 66*b* of graph 60*b* of FIG. 2, and electrode 48 may be biased to a potential substantially less than screen potential (segment 68 thereof) for increasing the landing angle of the electron beam 30.

The particular values of bias potential are selected in accordance with a particular tube 10 to obtain, for example, a suitable balance of reduced tube depth and reasonable yoke power in consideration of the effects of each of the bias potentials. Examples of typical bias potentials and ranges thereof are set forth in the following table for an example CRT:

| Electrode | Symbol | Example #1 | Example #2 | Example #3 |
|---|---|---|---|---|
| Screen Electrode 22 | $V_{22}$ = | 30 kV | 30 kV | 30 kV |
| Neck electrode 44 | $V_{44}$ = | 0–30 kV | 15 kV | 30 kV |
| Back Electrode 46 | $V_{46}$ = | 30–35 kV | 35 kV | 30 kV |
| Kick electrode 48 | $V_{48}$ = | 0–30 kV | 10 kV | 17–23 kV |

An example CRT may be an about 810-mm (about 32-inch) diagonal 16:9 aspect ratio format cathode ray tube having a viewable area of 660 mm (about 26 inch) width and 371 mm (about 14.6 inches) height. As a result of the reduced tube depth of the present invention, tube 10 has a depth D of about 280 mm (about 11 inches). Deflection yoke 16 may be a 110° or a 125° saddle-saddle type deflection yoke including a saddle-type horizontal coil, a saddle-type vertical coil, a ferrite core and a pair of permeable metal shunts for shaping vertical deflection for self convergence. With the 125° deflection-angle yoke, the diameter of tube neck 14 may be reduced to allow use of a smaller, lower power yoke 16. Preferably, deflection yoke 16 is a non-converging (non-self-converging) deflection yoke providing a total deflection angle of about 135–140° wherein each of the horizontal and vertical deflection coils is of the saddle-type. Specifically, at least the horizontal deflection coil preferably has a non-constant distribution of turns so that the number of turns effective at the entrance of the yoke is substantially greater than the number of turns effective at the exit of the yoke. The distribution of turns typically decreases monotonically between the yoke entrance and exit, but not necessarily linearly, as is determined by the particular arrangement of the shape and electrode arrangement of the cathode ray tube 10, the bias potentials to be applied thereto, and the desired characteristics.

Cathode ray tube 10 may employ a combination of electrodes including conductive coatings on tube enclosure 40 and metal electrodes supported within tube envelope 40. In the illustrated arrangement, neck electrode 44 and deflection-enhancing electrode 46 are a conductive coating on the wall of tube envelope 40 and are biased at a potential applied via feedthrough 45 and/or 47 penetrating the wall of tube envelope 40, or may be connected to screen electrode 22 to receive bias potential therefrom. Third electrode 48 is biased at a potential that is applied via feedthroughs 49 penetrating the wall of tube envelope 40. Shadow mask 24, supported by shadow mask frame 26, receives screen electrode 22 bias potential via feedthrough 25 penetrating the wall of tube envelope 40. Barium getter material 56 is placed at convenient locations, such as behind shadow mask frame 26 and electrodes 48*a*, 48*b*.

Because faceplate 20 is much shorter in the vertical dimension than in the horizontal dimension (which is illustrated in FIG. 1), electrode 48 need not be rectangular so as to act on electrons directed toward the top and bottom edges of the viewable area of faceplate 20, but may be two straight L-shaped formed metal electrodes 48*a*, 48*b* receiving bias potential via feedthroughs 49*a*, 49*b*, respectively, to act only on those electrons directed towards the left and right vertical edges of tube 10. Electrodes 48*a*, 48*b* are supported by feedthroughs 49*a*, 49*b*, respectively, such as by a weld or a conductive glass frit to metal attachment.

A conductive coating electrode on the inside surface of tube 40, such as on faceplate 20 or glass envelope 40, is preferably a sprayed, sublimated, spin coated or other deposition or application of graphite, carbon or carbon-based materials, aluminum or aluminum oxide, or iron oxide, or other suitable conductive material. Where electrodes, such as electrodes 48*a*, 48*b*, are spaced away from the wall of tube envelope 40, such electrodes are preferably formed of a suitable metal such as a titanium, Invar alloy, steel, stainless steel, or other suitable metal, and are preferably stamped. If magnetic shielding is desired to shield electron beam 30 from unwanted deflection caused by the earth's magnetic field and other unwanted fields, a magnetic shielding metal, such as mu-metal, steel, or a nickel-steel alloy, may be employed.

In the FIGURES, arrows indicate an arbitrary reference direction of current flow in the various portions of the deflection coil, it being recognized that current in the coil is not static, but varies at the scanning rate (typically increasing and decreasing as a "sawtooth" shaped waveform), and may be positive and negative, during each scan cycle. Deflection coil "end turns" are the portions of the turns of the deflection coil transverse to the Z axis and intersecting the Y-Z plane, and are generally referred to as "gun end turns"or as "gun-side end turns" if transverse proximate the yoke entrance (the end nearer the electron gun) and as "screen end turns" or as "screen-side end turns" if transverse proximate the yoke exit (the end nearer the screen). End turns are distinguished from "side turns" which are the portions of the turns of the deflection coil disposed in a direction generally along the Z axis and on either side of the Y-Z plane, usually symmetrically. Also, "Le" represents the length of the yoke entrance region, "Lx" represents the length of the yoke exit region, and "Li" represents the length of the yoke region intermediate the entrance and exit regions wherein the cumulative turns count is substantially constant at or near the maximum number of turns, each of the foregoing lengths being defined in a direction parallel to the Z axis.

Figure 3:
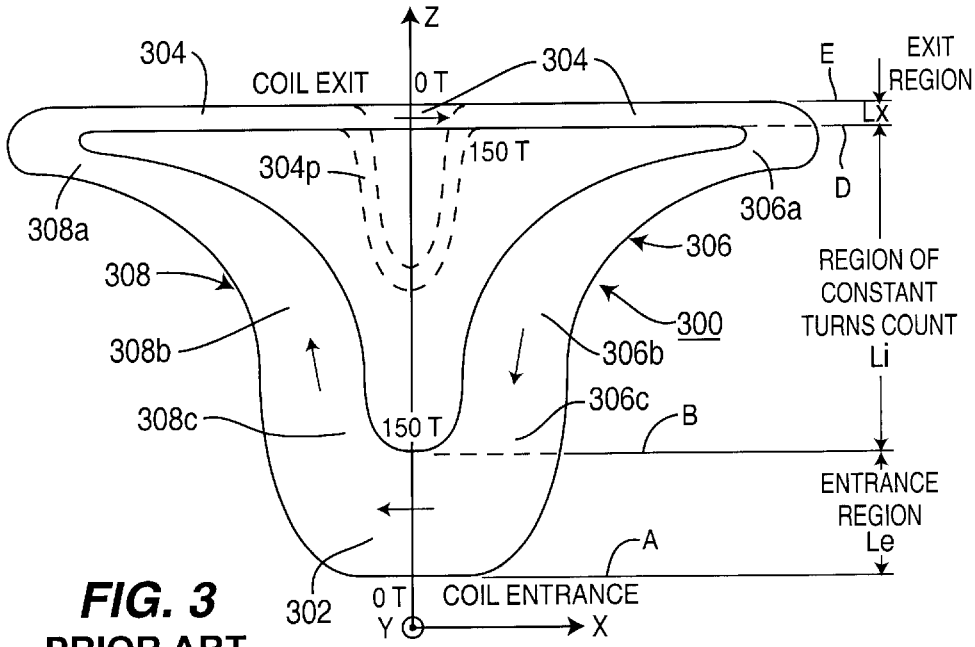
FIG. 3 PRIOR ART
FIG. 3 is a plan view schematic diagram of a Prior Art deflection coil.

FIG. 3 is a plan view schematic diagram of a Prior Art saddle-type deflection coil. Conventional deflection yokes employ deflection coils having a "uniform" or "constant" turns distribution, i.e. the number of turns producing the magnetic deflection field is substantially the same over the entire Z-axis length of the yoke, except for relatively short (small) regions at the yoke entrance and exit where the number of turns changes sharply (i.e. over a short distance) from zero to the constant number of turns. Prior art deflection coils typically have all or almost all of their end turns grouped together in the relatively short entrance and exit regions, and have a relatively large central or intermediate region in which the cumulative turns count is relatively constant.

For example, conventional deflection yoke coil 300 of FIG. 3 represents a horizontal saddle-type coil that has 150 turns (150 T) arranged in a single loop. The 150 turns of coil 300 are bunched close together to define a single loop, e.g., as they cross transversely to the Z axis near the yoke entrance (gun-side end turns indicated by numeral 302) and near the yoke exit (screen end turns indicated by numeral 304), thereby with side turns 306, 308 to define a large central opening or window 310 surrounded by the coil 300. Thus, the cumulative number of turns increases sharply in the relatively short distance of the entrance region between the entrance plane (line A) and coil window 310 )line B), is relatively uniform or constant over the relative long dimension of window 310 (intermediate region between lines B and D), and decreases sharply over a relatively short distance of the exit region between window 310 (line D) and the exit plane (line E), as is illustrated by graph G-300 of FIG. 5. Side turn portions 306*a*–306*c* and 308*a*–308*c* are identified for later reference.

As the electrons of an electron beam travel in the direction along the positive Z axis of the CRT from the electron gun towards the screen, they pass through the deflection region of the deflection yoke and are under the influence of the magnetic field produced by the deflection coils thereof. As the electrons of the electron beam pass the entrance of the conventional deflection yoke 300, they quickly come under the influence of the magnetic field produced by all 150 turns 302 of deflection coil 300 disposed near the yoke entrance. As the electron beam passes through the deflection region of the deflection yoke, the electrons continue under the influence of the magnetic field produced by all 150 turns of deflection coil 300 (i.e. a region of constant or uniform cumulative turns count) over a relatively long distance until they reach the yoke exit. Then the electron beams leave the influence of the 150 turns of coil 300 relatively quickly as they pass the yoke exit and, having been deflected, continue to travel towards the screen.

Figure 4:
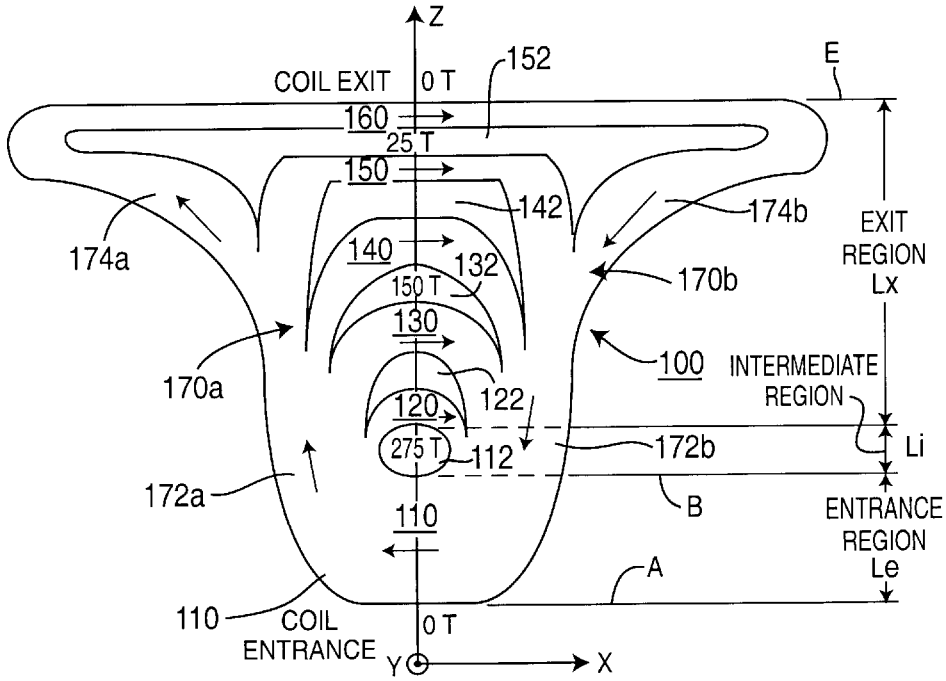
FIG. 4 is a plan view schematic diagram of a deflection coil for a deflection yoke in accordance with the invention.

As is known in the art, a small number of correction turns may be utilized in deflection coil 300 for correcting coma, pincushion distortion and other effects, and such correction turns are generally considered as being in the intermediate region. For example, a small number of the end turns in bundle 304 may be formed in a loop 304*p* extending towards the yoke entrance for correcting pincushion distortion FIG. 4 is a plan view schematic diagram of a deflection coil 100 for a deflection yoke 16 in accordance with the invention. Deflection coil 100 has a negative-bias non-constant turns distribution. In a non-constant turns distribution or a non-constant turns biased deflection coil, the number of turns of the deflection coil producing magnetic field for deflecting electrons varies over the length of the coil (the deflection region of the deflection yoke) in relation to the location between the yoke entrance and yoke exit. In other words, there is a gradient of the number of turns effective at any given location between the yoke entrance and exit. The turns gradient may decrease in a monotonic and linear manner as illustrated by the example deflection coil 100 shown in FIG. 4, which is referred to as a negative-biased turns distribution, or may increase, and/or may be non-monotonic and/or non-linear.

As used herein, a deflection coil is referred to as having a "negative turns distribution" or a "negative bias" or a "negative turns bias" if the cumulative number of turns reaches a maximum near the end nearer the yoke entrance and decreases over the yoke length towards the yoke exit at which there are a lesser number of turns. A deflection coil is referred to as having a "positive turns distribution" or a "positive bias" or a "positive turns bias" if the cumulative number of turns is smaller near the yoke entrance and increases over the yoke length towards the yoke exit nearer which there are a greater number of turns. In any non-constant turns distribution, the decrease or increase may be monotonic or non-monotonic and/or may be linear or non-linear. Because each turn is a closed loop of wire, the cumulative number of turns along the Z-axis first increases from zero turns to a maximum value and ultimately returns to zero turns, and graphical representations may be utilized to describe the coil. Such graphical representations typically "smooth" the graphed data between discrete values, rather than illustrate discrete steps produced by each turn or group of turns.

Example deflection coil 100 has 275 turns (275 T) of which all 275 turns are bundled 110 at the gun-side end turn end, so that the cumulative number of turns increases sharply over a short distance near the yoke entrance, e.g., between lines A and B. Along the Z-axis direction of coil 100, at least three additional bundles 120, 130, . . . 160 of turns of varying number are disposed transversely at various locations along the Z axis so that the cumulative number of turns progressively decreases over the relatively long distance between lines B and E. For example, transverse bundle 120 of end turns with bundle 110 defines window 112 of a very small intermediate region, and additional bundles 120, 130, 140, 150, 160 of turns disposed progressively along the relatively long Z-axis length Lx of the exit region of coil 100 respectively define additional small windows 122, 132, 142, 152.

As the electrons of the electron beam pass the entrance of the deflection yoke, they quickly come under the influence of the magnetic field produced by all of the 275 turns 110 of deflection coil 100 disposed near the yoke/coil entrance. As the electron beam passes through the relatively short intermediate deflection region of the deflection yoke, the electrons continue under the influence of the magnetic field produced by all 275 turns of deflection coil 100 (i.e. a region of constant or uniform cumulative turns count) over a relatively short distance. As the electron beam then passes through the relatively long exit region of the deflection yoke, the electrons continue under the influence of the gradually decreasing magnetic field produced by the cumulatively decreasing number of turns (i.e. less than all 275 turns) of deflection coil 100 over a relatively long distance. until they reach the yoke exit. Then the electron beams leave the influence of coil 100 and, having been deflected, continue to travel to the screen.

It is noted that the number of end turns comprising each of the bundles 120, 130, . . . 160 may be same or may be different. In the 275 turn example of FIG. 4, bundles 120 and 130 combined include 125 turns, bundles 140 and 150 combined include 125 turns, and bundle 160 includes 25 turns. Alternatively, the end turns of the exit region may be evenly or unevenly spread over the exit region. Thus, the number of bundles or groups of turns in the exit region is at least three and may be as many as the total number of turns of deflection coil 100. Typically, where the end turns are bundled, at least one bundle of end turns is disposed to the gun (entrance) side of the deflection center (not the physical midpoint) of the deflection yoke and at least two bundles of end turns are disposed to the screen (exit) side thereof.

Deflection coil side turns are disposed in two bundles 170*a*, 170*b* disposed symmetrically with respect to the Y-Z plane on opposite sides thereof and the turns therein may be relatively close together or may be relatively spread apart for imparting certain characteristics to the deflection yoke employing coil 100. For example, the portions of turns in bundle 110 and in the portions 172*a*, 172*b* of side turn bundles 170*a*, 170*b* aside end-turn bundles 110 and 120 and window 112 may be spread to span a relatively wide angle for providing a winding turn distribution that is rich in "negative third harmonics" proximate the yoke entrance which is useful for the correction of coma. Also, the side turns of bundle portions 174*a*, 174*b* aside end-turn bundles 140 and 150 may be relatively close together to span a short distance to provide a winding distribution that is rich in "positive third harmonics" which is useful for self-convergence of the deflection yoke and for correcting astigmatism, and, more towards the exit plane, for the correction of top-bottom (north-south) pincushion distortion.

As is known to those of skill in the art, Fourier winding harmonics produced by the arrangement of side turns in a deflection coil refer to the magnetic field produced by the deflection coil. In a deflection coil for producing a uniform magnetic field, the side turns are arranged in a cosine distribution symmetrical with respect to the Y-Z plane. Side turns are referred to as providing "negative third harmonics" if the side turns are shifted towards the Y-Z plane relative to the uniform field cosine turns distribution (i.e. towards the center), and are referred to as producing "positive third harmonics" if the side turns are shifted away from the Y-Z plane relative to the uniform field cosine turns distribution (i.e. towards the side edges).

Figure 5:
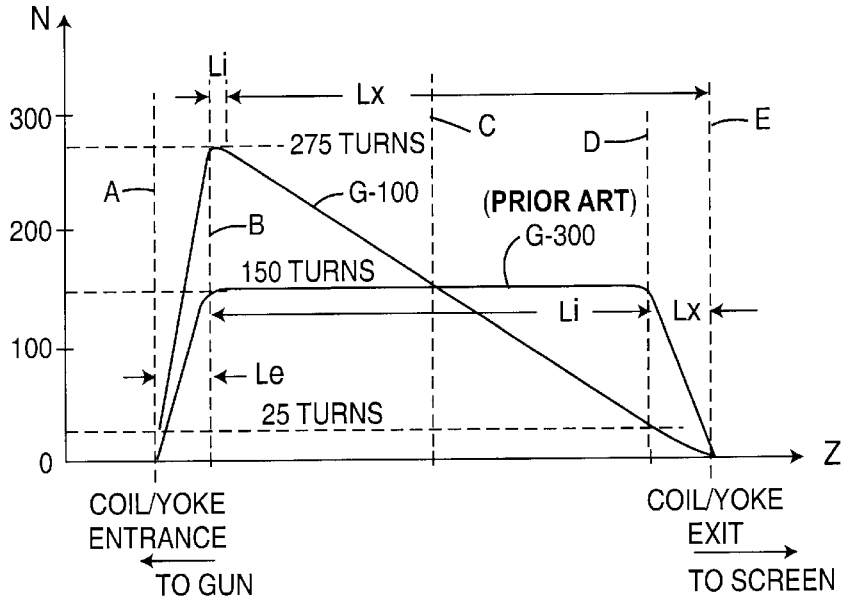
FIG. 5 is a graphical representation comparing a conventional deflection yoke having constant or uniform turns distribution with the example embodiment of FIG. 4 in accordance with the invention.

FIG. 5 is a graphical representation of cumulative turns count plotted against distance along the Z axis in the deflection region between the deflection yoke entrance and exit. FIG. 5 compares a conventional deflection yoke coil 300 having a constant or uniform turns distribution as in FIG. 3 (labeled Prior Art) with an example embodiment of a deflection yoke coil 100 having a non-constant turns distribution as in FIG. 4. Lines A, B, C, D and E are provided to relate typical physical locations on the plan views of FIGS. 3 and 4 to the graphs of FIG. 5. The respective intermediate region lengths Li and the exit region lengths Lx for each of coils 100 and 300 are also indicated thereon close to graphical representations G-100 and G-300, respectively.

For the prior art coil represented by graph G-300, the cumulative turns count is constant at 150 turns over most of the length of the coil, with sharp changes over the very short entrance region (between lines A–B) and the very short exit region (between lines D–E). Typically, the length Li of the intermediate region of a conventional deflection coil is substantially greater than the length Le of the entrance region or the length Lx of the exit region thereof, and of the combined length Le+Lx. In addition, the cumulative number of turns in the intermediate region does not vary by more than about 5–10%, e.g., for correction turns, such as utilizing a small number of turns near the gun (entrance) end for coma correction and/or a small number of turns near the screen (exit end) for pincushion correction. Correction turns may be provided as part of the deflection coil or by an adjacent separate correction coil.

The deflection coil 100 embodiment represented in FIG. 5 by graph G-100 has a negative-biased non-constant turns distribution in that the cumulative number of turns decreases between the yoke entrance region and the yoke exit, i.e. over a relatively long distance of the exit region. Typically, the length Le of the entrance region and the length Li of the intermediate region are very much smaller than is the length Lx of the exit region. One way to define the desirable non-constant turns distribution is in terms of the distance $L_{P\%}$ along the combined length (Li+Lx) of the deflection coils along the Z-axis direction at which the cumulative number of turns decreases to a given portion P of the maximum cumulative number of turns $N_T$ of the deflection coil. Typically, the maximum cumulative number of turns $N_T$ occurs at the boundary between the entrance region and the intermediate region, e.g., at the line B between the entrance and intermediate regions.

For example, where the portion P is 0.8 or 80%, the cumulative number of turns decreases to 80% of the maximum number of turns $N_T$ no further than 0.68 (68%) of the distance from the beginning of the intermediate region to the exit end of the exit region, i.e. at a distance 0.68 (Li+Lx) or 68% of the combined length of the intermediate and exit regions. This condition may be represented by:

$$\frac{L_{80\%}}{Li+Lx} \leq 0.68 \qquad \text{[Equation 1]}$$

for $N/N_T$=0.8. In other words, the ratio $N/N_T$ is 0.8 or less over 32% or more of the combined length of the intermediate and exit regions (Li+Lx). Typically, the length ratio of Equation 1 is less than 0.6 for most deflection coils and is less than 0.5 for a typical deflection coil. In other words, the ratio $N/N_T$ is 0.8 or less over 40% or more and 50% or more, respectively, of the combined length (Li+Lx).

Further, the cumulative turns count decreases to 50% of the maximum number of turns $N_T$ no further than 0.8 (80%) of the distance from the beginning of the intermediate region to the exit end of the exit region, i.e. at a distance 0.8 (Li+LX). This condition may be represented by:

$$\frac{L_{50\%}}{Li+Lx} \leq 0.8 \qquad \text{[Equation 2]}$$

for $N/N_T$=0.5. In other words, the ratio $N/N_T$ is 0.5 or less over 20% or more of the combined length of the intermediate and exit regions (Li+Lx). Any one or more of the foregoing criteria may be utilized to define the invention.

Alternatively, the cumulative number of turns at the midpoint of the combined length of the intermediate and exit regions, i.e. at (Li+Lx)/2, is typically in the range of about 0.35–0.77 (35–77%) of the maximum cumulative number of turns $N_T$ and is always less than 0.80 (80%) thereof. A typical deflection yoke according to the invention has negative bias and a cumulative turns count at the (Li+Lx)/2 midpoint of less than 80% of the maximum number of turns. Alternatively, the distribution of turns may be defined in terms of "slope" of the distribution of cumulative turns. For example, the cumulative turns distribution may be defined with respect to the (Li+Lx)/2 midpoint by the ratio:

$$\frac{N_{(Li+Lx)/2}}{N_T} \leq 0.8 \qquad \text{[Equation 3]}$$

at (Li+Lx)/2, where:

N represents the cumulative number of turns, and $N_{(Li+Lx)/2}$ represents the cumulative number of turns at the midpoint of the combined length of the intermediate and exit regions in the Z axis direction, and $N_T$ represents the maximum cumulative number of turns.

Figure 6:
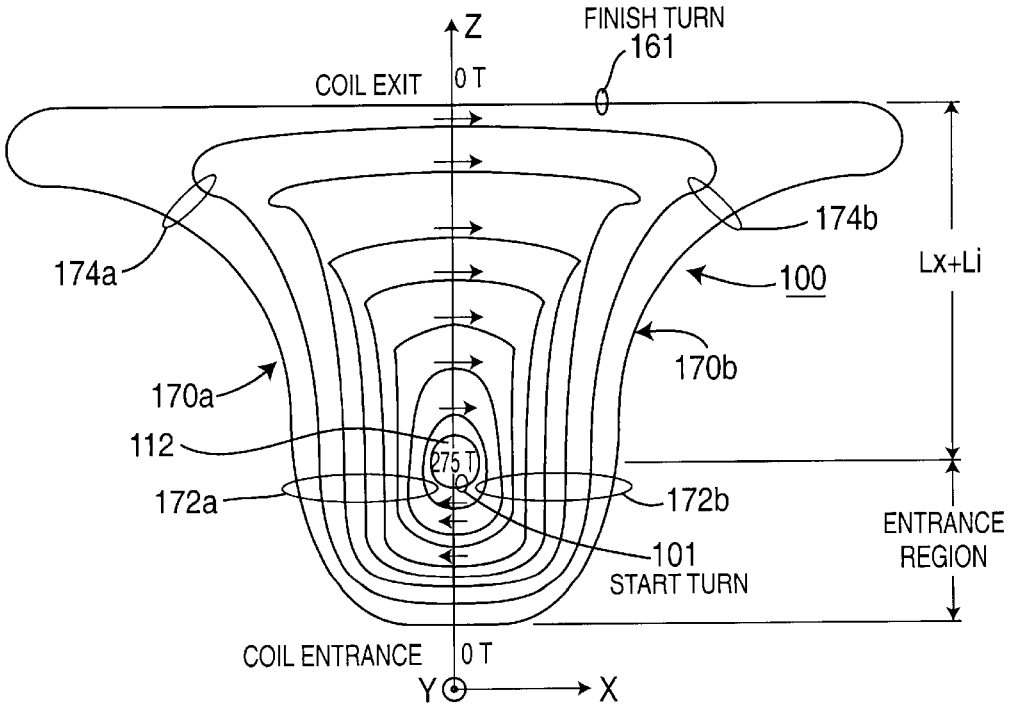
FIG. 6 is a plan view schematic diagram of an alternative deflection coil for a deflection yoke in accordance with the invention.

FIG. 6 is a plan view schematic diagram of an alternative deflection coil 100 for a deflection yoke in accordance with the invention in which certain turns of coil 100 are illustrated to show the approximate positions of certain turns thereof and to illustrate the winding of coil 100. It is noted that the screen-side end turns in the exit region Lx are spread over the distance Lx+Li for providing a gradual progressively decreasing cumulative turns count over the exit region, and so the number of bundles or groups of turns may be as large as the number of turns.

In winding coil 100, the first turn 101 is started at the beginning of the winding process to surround the small area that will become window 112 and the coil 100 is wound outward therefrom. As the wire is positioned to define the turns, the position is determined for providing the desired physical arrangement for increasing or decreasing the positive and negative third harmonics useful for certain corrections of the CRT deflection. Typically, the wire is placed onto a form that defines the shape of the coil and that has pins, pegs or other features against which or around which the wire is placed to form the desired turns and shape. The winding ends with the last or finish turn 161 which is at the extreme exit end of coil 100.

In addition to the distribution of the end turns of coil 100 for reducing HSE, the distribution of the turns of coil 100 in the exit region in FIG. 6 illustrates that the turns may be physically spread over smaller or larger distances for defining a number of transverse end-turn bundles (between three and the number of turns) over the distance Lx. In addition, portions of side turns 170*a*, 170*b* may be spread or grouped for providing negative and/or positive third harmonics for correcting coma, and/or pincushion, and/or for providing self-convergence. For example, coil portions 172*a*, 172*b* may be used to provide negative third harmonics for correcting coma, and/or coil portions 174*a*, 174*b* may be used for providing positive third harmonics for correcting pincushion and/or for providing self-convergence.

It is noted that the arrangement of deflection coils 100 are negative bias coils wherein the cumulative turns count decreases gradually, and generally progressively, along the Z axis from the yoke entrance to the yoke exit. The lesser number of turns in the region of the deflection coil near the yoke exit tends to decrease the effective diameter of the deflection yoke. The arrangement tends to shift the deflection center of the deflection yoke towards the yoke entrance which tends to slightly reduce the angular deflection required to deflect the electron beam to the edges and corners of the screen. One or both of these aspects tend to increase the deflection sensitivity and/or reduce the HSE of the deflection yoke, whether the yoke cross section is circular or rectangular or something in between. Thus, a deflection yoke employing deflection coils having turns distributions as described may be non-converging or self-converging.

An example 140° deflection yoke having horizontal deflection coils as described herein reduced HSE from about 12 mJ (conventional yoke) to about 8.4 mJ with a 140° wide CRT (30 kV screen/anode potential) of the sort shown in FIG. 1. An example 120° deflection yoke having horizontal deflection coils as described herein reduced HSE from about 7.1 mJ (conventional yoke) to about 5.4 mJ with a 120° CRT (30 kV anode potential).

Figure 7A:
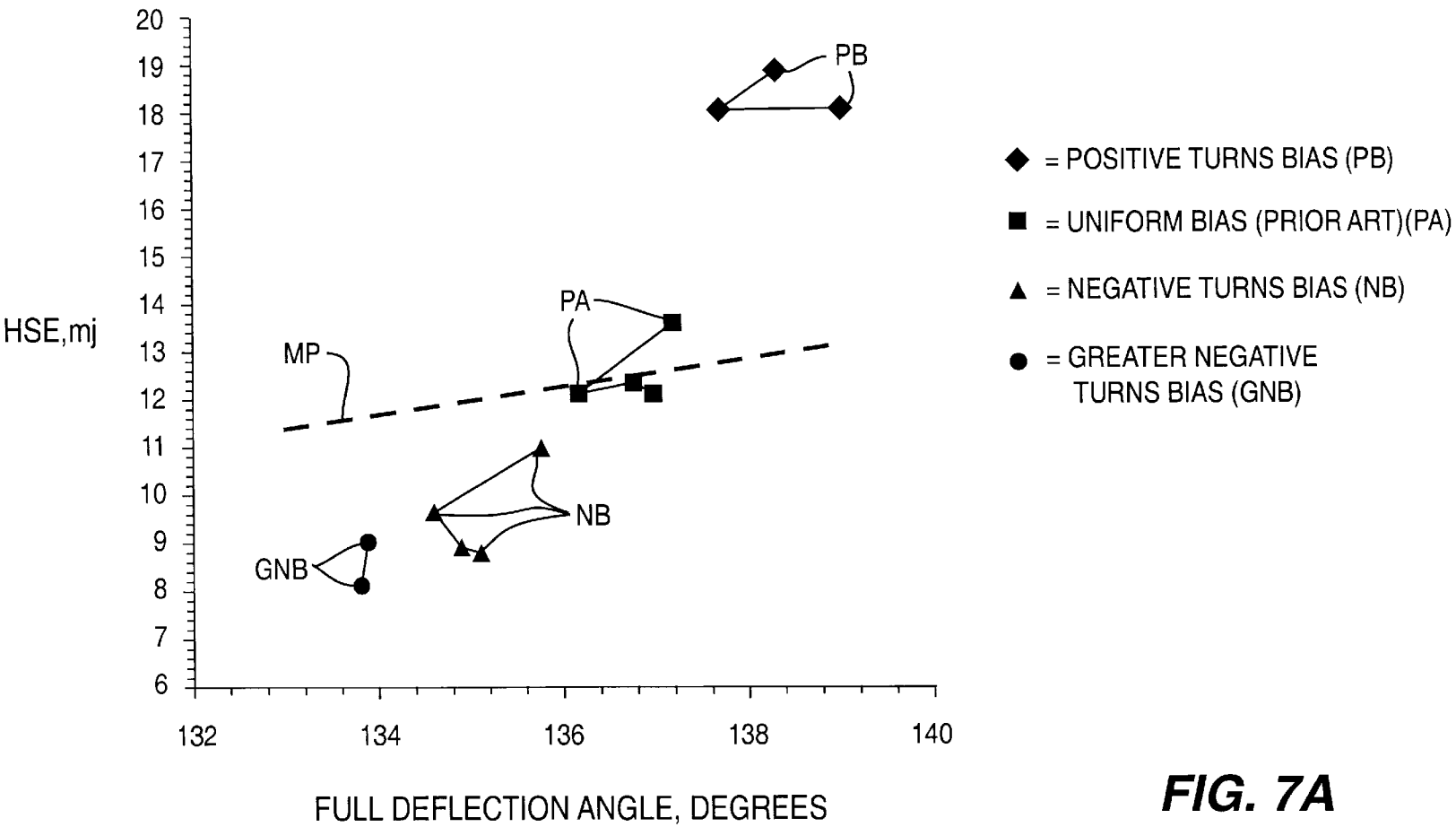
FIG. 7A is a graphical representation of parametric data comparing conventional deflection yokes to deflection yokes having a positive bias deflection coil and to deflection yokes having a negative bias deflection coil.

FIG. 7A is a graphical representation illustrating parametric analysis data comparing conventional deflection yokes (square symbols PA) to deflection yokes having a positive turns bias coil (diamond symbols PB), and to deflection yokes (triangle and circular symbols) having negative turns bias coils. The positive turns bias deflection yokes (square symbols PB) have positive turns bias deflection coils with 75, 150 and 225 turns (cumulatively) at line positions B, C and D, respectively. The negative turns bias deflection yokes (triangle symbols NB) have negative turns bias deflection coils with 225, 150 and 75 turns (cumulatively) at line positions B, C and D, respectively, in FIG. 5. Other negative turns bias deflection yokes (circular symbols GNB) have more highly negative turns bias deflection coils with 275, 150 and 25 turns (cumulatively) at line positions B, C and D, respectively, and provide the lowest HSE. In FIG. 7, plural symbols of like type represent different values for the deflection yoke length in the Z-axis direction. The parametric data appears to indicate that, at least within limited ranges, increasing the yoke exit diameter and/or increasing the yoke entrance position towards the electron gun each tend to reduce HSE. Dashed line MP represents an example of an upper practical level for HSE.

Figure 7B:
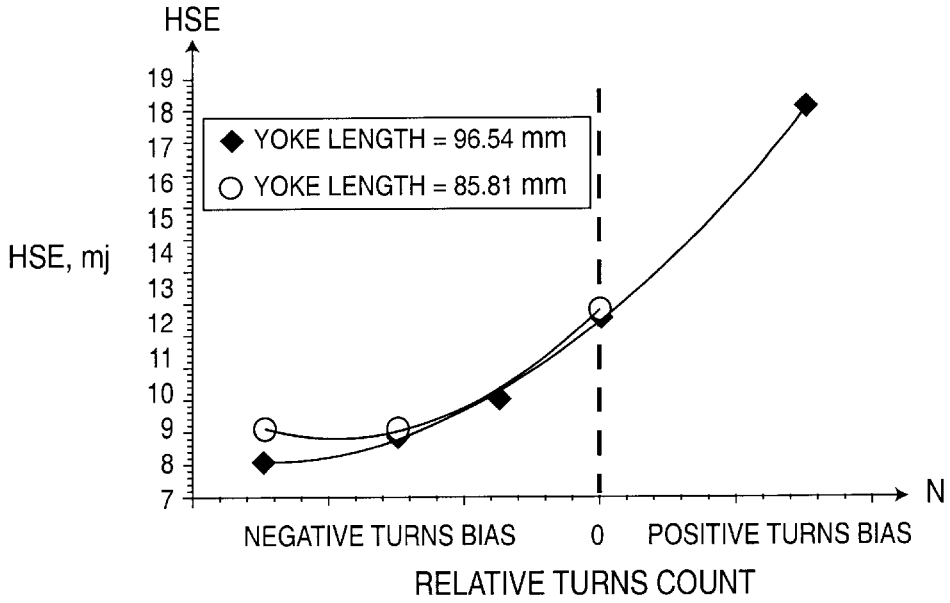
FIG. 7B is a graphical representation of parametric data for deflection yoke HSE in relation to deflection yoke turns distributions.

FIG. 7B is a graphical representation illustrating parametric data wherein the HSE of example deflection yokes is plotted against the relative turns count of the horizontal deflection coil. The relative turns count thereof is indicative of the cumulative number of turns at a location near the exit plane of the deflection yoke relative to the cumulative turns count at the mid-point of the Lx+Li length of the deflection coil. The horizontal axis is representative of the relative slope of the turns distribution over the Lx+Li length of the coil. N=0 corresponds to a constant turns distribution as in a prior art deflection coil, while N>0 represents a positive turns bias and N<0 represents a negative turns bias. FIG. 7B illustrates that a deflection yoke employing negative bias non-constant turns distribution horizontal deflection coils can provide an HSE reduction of about 25–35%.

Figure 8A:
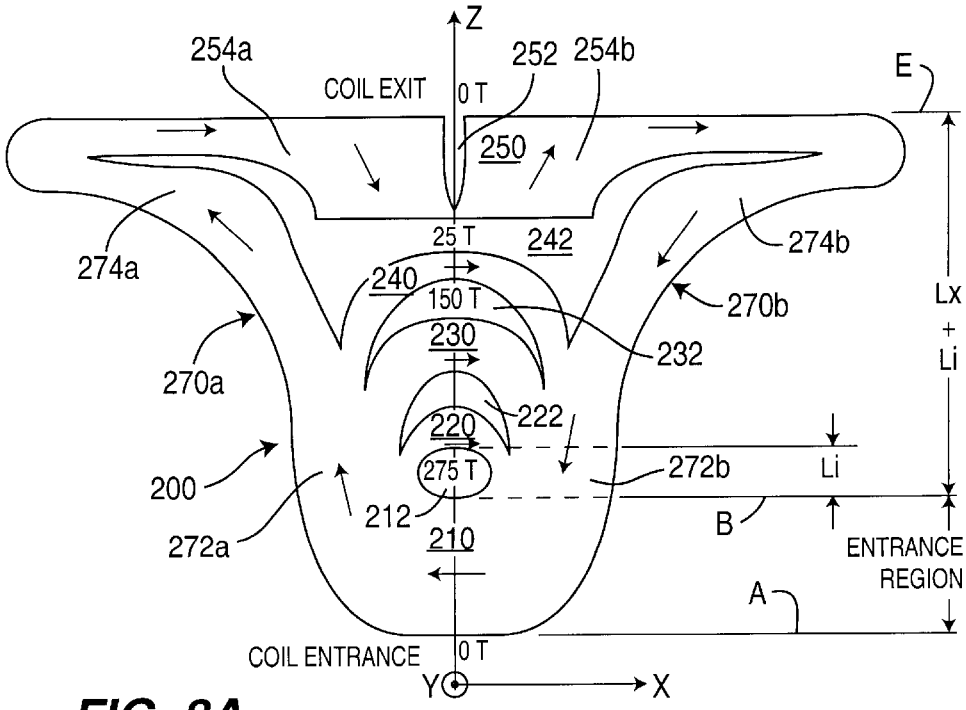
FIG. 8A is a plan view schematic diagram of an embodiment of a deflection coil in accordance with the invention having a negative biased non-constant turns distribution with negative and positive turns.

FIG. 8A is a plan view schematic diagram of a deflection coil 200 having a negative biased non-constant turns distribution with reverse direction and forward direction turns, that may be employed as the horizontal coils for a self-converging deflection yoke. Forward and reverse direction turns carry current in opposite directions along the Z axis on the same side of the Y-Z plane, e.g., the current in one flows in a direction generally towards the coil exit and the current in the other flows in a direction generally away form the coil exit. Typically, the direction in which the principal current flows is referred to as the forward direction, e.g., that of side turns 270*a*–270*b*.

Deflection coil 200 has coil turns arranged in bundles or groups 210, 220, 230, 240, 272 defining windows 212, 222, 232, generally similar to groups 110, 120, 130, 140, 172, and windows 112, 122, 132, respectively, of deflection coil 100 of FIGS. 4 and 6, and may provide a winding distribution rich in negative third harmonics for coma correction. In coil 200 of FIG. 8, however, the side turns portions in side bundles 274*a*, 274*b* are spread over a relatively larger distance (e.g., at angles of about 0–30° with respect to the horizontal X-Z plane) and the turns in regions 254*a*, 254*b* of transverse end turn bundle 250 reverse direction (i.e. relative to the direction of current flow in regions 274*a*, 274*b*) and are also spread over a relatively larger distance (e.g., at angles of about 30–90° with respect to the horizontal X-Z plane), thereby to define a relatively wider angle of 0–90°. As a result, the winding distribution is very rich in positive third harmonic for self convergence and for top-bottom pincushion correction (where coil 200 is a horizontal coil). In turn bundle 250 of coil 200, the turns 254*a*, 254*b* are formed in the region of the Z axis to extend back towards the coil entrance (e.g., in the reverse direction away from the coil exit opposite to the direction of the other turns of coil 200) to form an opening 252. Such turns distribution arrangement provides correction turns that may be utilized for reducing pincushion distortion.

Figure 8B:
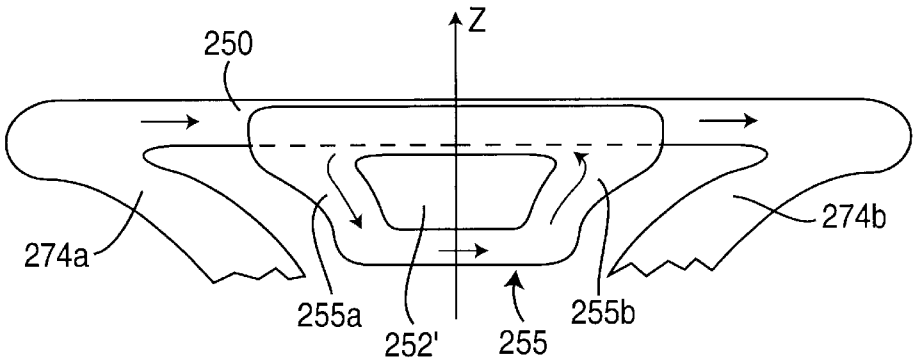
FIG. 8B is a plan view schematic diagram of a detail portion of FIG. 8A.

FIG. 8B illustrates an alternative arrangement for coil 200 in which turns bundle 250 is not shaped towards the coil entrance and a correction coil 255 is provided, e.g., for correcting distortion. The current in coil 255 flows in the opposite direction to the current in turns bundle 250, thereby providing an effective net current of substantially zero where coil 255 overlies turns bundle 250 when both produce the same value of ampere-turns. If the current flow in side turns 274*a*, 274*b* is defined as the forward direction, then the current flow in coil 255 is in the reverse direction, as indicated by the respective arrows. Coil 255 defines a window 252'.

Figure 9:
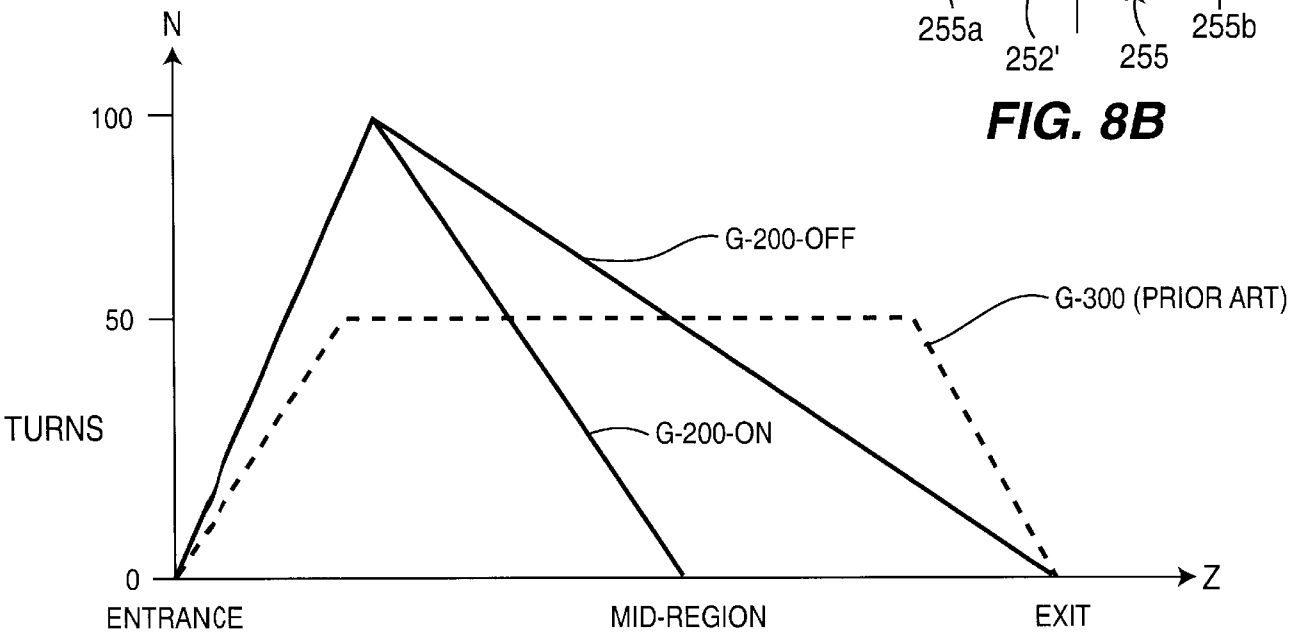
FIG. 9 is a graphical representation of parametric data comparing a conventional deflection yoke to a deflection yoke in accordance with FIG. 8.

FIG. 9 is a graphical representation of parametric data comparing a conventional deflection yoke coil (dashed line G-300 Prior Art) to deflection yoke coil 200 as in FIG. 8.

Along the Z axis direction from the yoke entrance to the yoke exit, the cumulative number of turns N of coil 200 increases sharply and then decreases gradually. Line G-200-ON represents the cumulative number of turns N of coil 200 "on axis," i.e. taken where coil 200 intersects the Y-Z plane, and reaches zero at a certain distance before the yoke exit plane. Line G-200-OFF represents the cumulative number of turns N of coil 200 "off axis," i.e. taken on either side of the Y-Z plane, and reaches zero at the yoke exit plane. Thus, coil 200 may be said to have a negative turns bias with all forward turns along the Z axis, but to have a negative turns bias with both forward and reverse turns on both sides of the Y-Z plane. As a result, the first harmonic tends to be reduced to zero at the yoke exit and the positive third harmonics are relatively high.

Figure 10A:
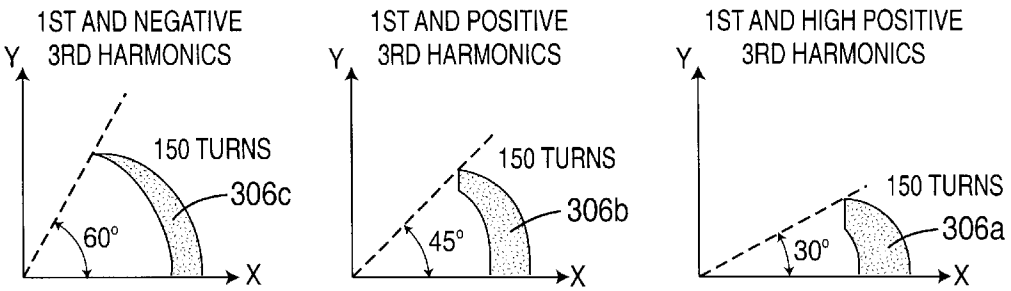
FIG. 10A PRIOR ART
FIGS. 10A, 10B and 10C are graphical representations illustrating certain cross-sections of three different deflection coil arrangements.
Figure 10B:
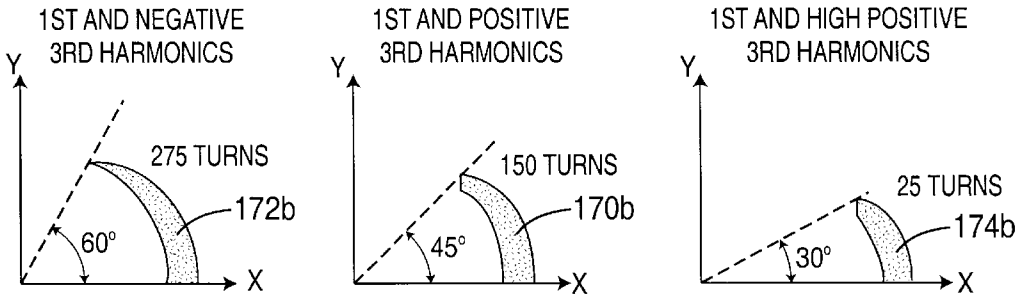
Figure 10C:
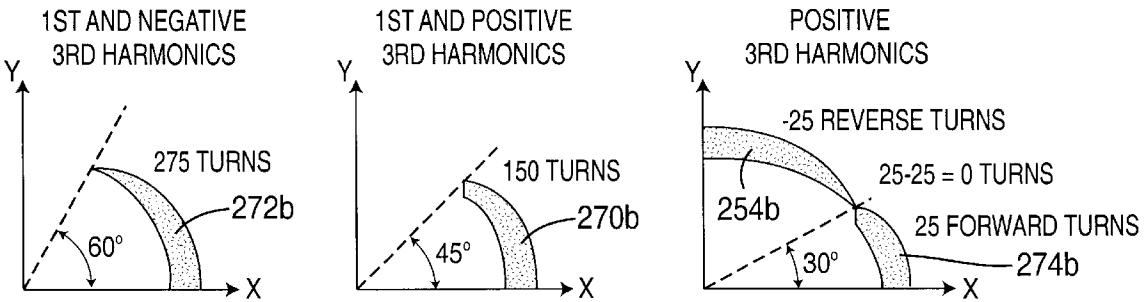

FIGS. 10A, 10B and 10C are graphical representations illustrating certain cross-sections of three different deflection coil arrangements. The first row of graphs (FIG. 10A) represents a conventional deflection yoke having coils with a constant or uniform turns distribution as in coil 300 of FIG. 3, the second row of graphs (FIG. 10B) represents a defection yoke having coils with a negative biased non-constant turns distribution with all forward direction turns as in coil 100 of FIGS. 4 and 6, and the third row of graphs (FIG. 10C) represents a deflection yoke having coils with a negative biased non-constant turns distribution with forward and reverse direction turns as in coil 200 of FIG. 8. For each of FIGS. 10A to 10C, each graph represents one quadrant of a spatial distribution of turns of a deflection coil, i.e. in cross-section cut in a plane parallel to the X-Y plane. For each of FIGS. 10A to 10C, the first column depicts the cross-section of the side turns of the deflection yoke near the entrance region thereof, the center column depicts the cross-section of the side turns of the deflection yoke in the mid-region thereof, and the right column depicts the cross-section of the side turns of the deflection yoke near the exit thereof. Side turn regions of each of coils 100, 200, 300 are depicted in FIGS. 10A–10C using the same numerical identifiers as are used in FIGS. 4, 6 and 8, respectively.

Figure 11A:
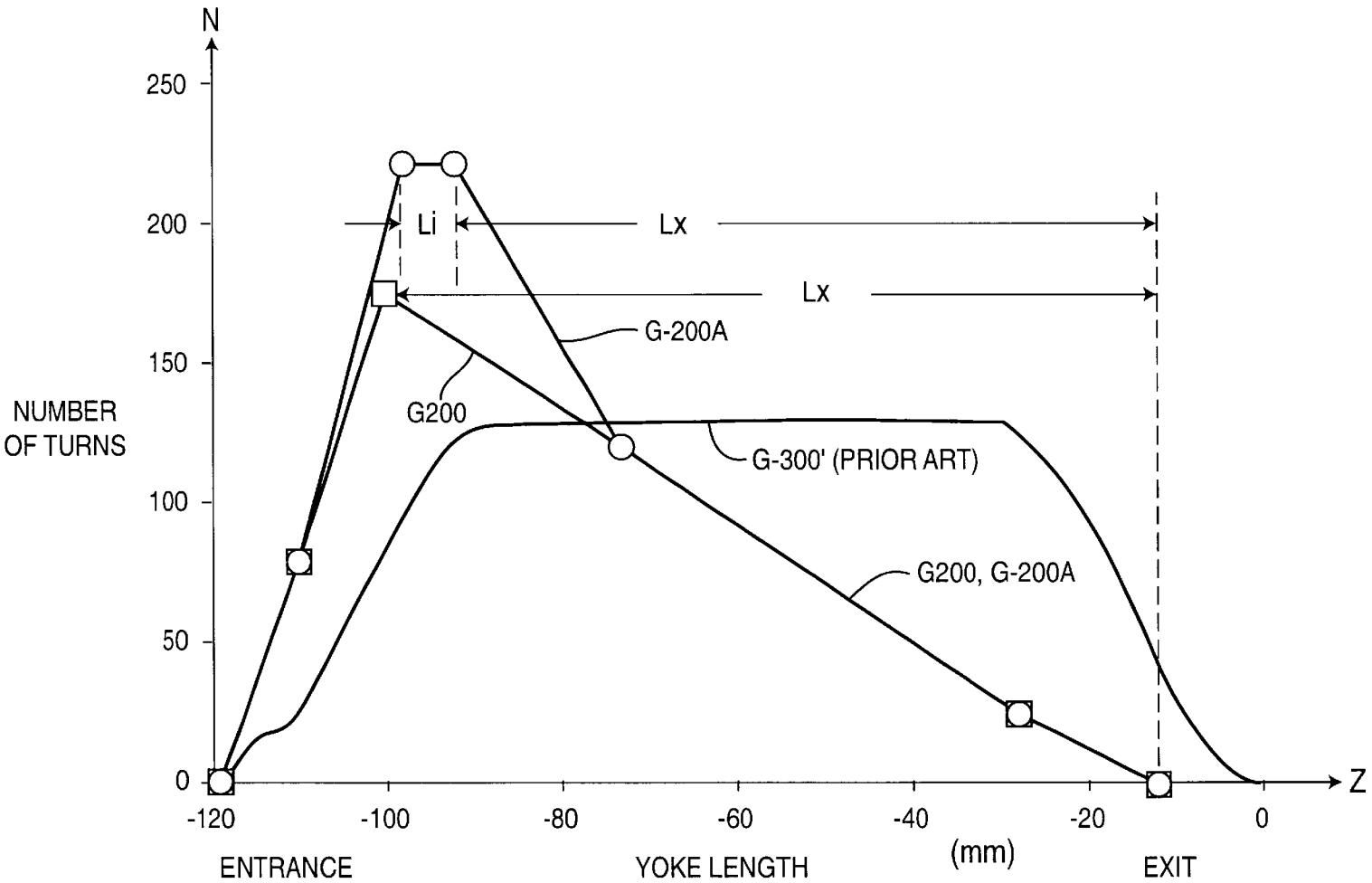
FIGS. 11A, 11B and 11C are graphical representations illustrating examples of turns distributions for a conventional deflection yoke and for example embodiments according to the invention having linear and nonlinear negative biased non-constant turns distributions.
Figure 11B:
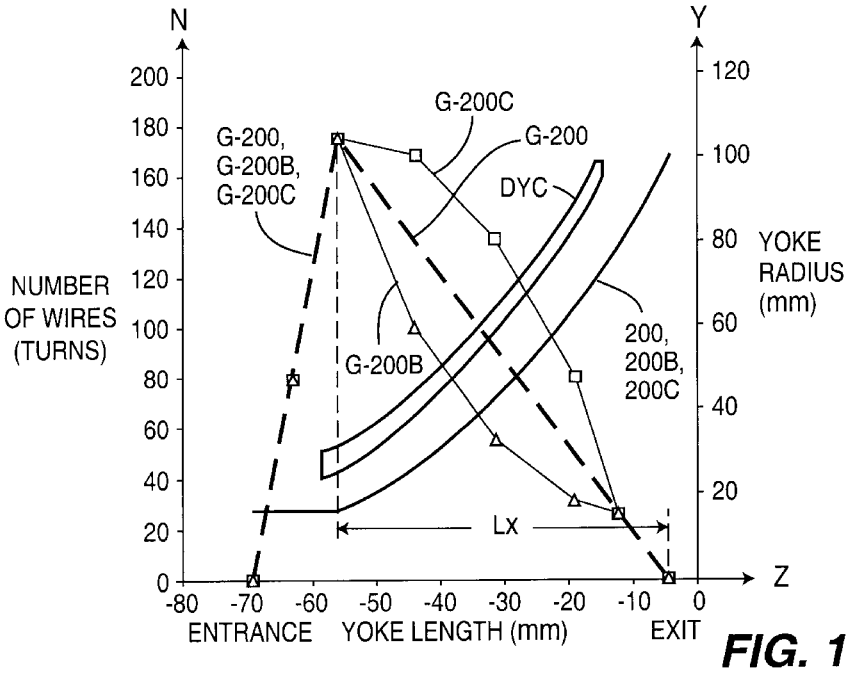
Figure 11C:
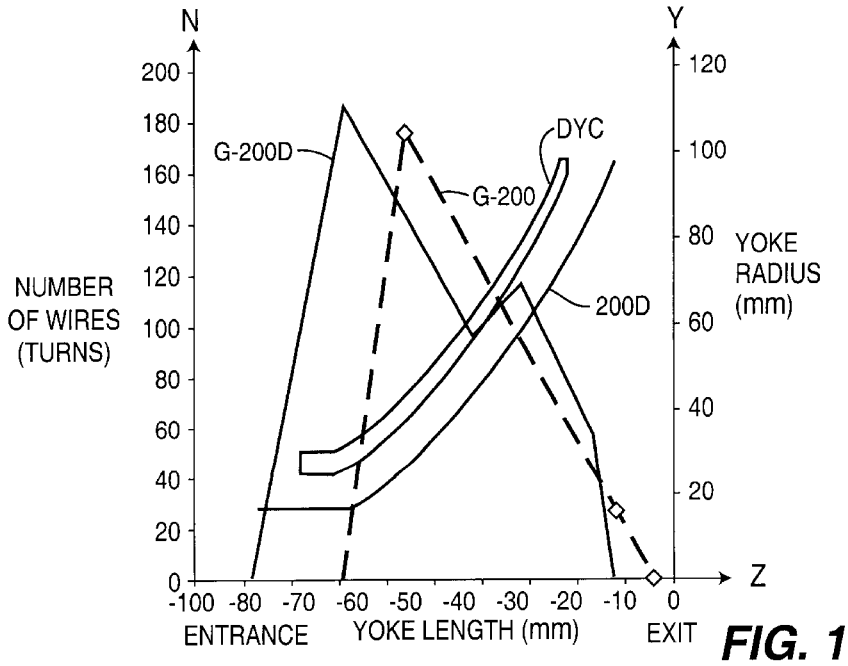

FIGS. 11A, 11B and 11C are graphical representations illustrating examples of turns distributions for a conventional deflection yoke G-300' and for example embodiments according to the invention having linear and nonlinear negative biased non-constant turns distributions. In FIG. 11A, characteristic G-300' of a prior art deflection coil similar to prior art coil 300 has a slight positive turns distribution near its entrance, perhaps reflecting turns spread for coma correction, and a slightly rising but substantially constant turns distribution through its mid-region. Characteristic G-200 represents a linear negative bias turns distribution, as for deflection coil 200, and has an intermediate region that is extemely small (not visible) and has a very long exit region Lx. Alternatively, characteristic G-200 A illustrates a deflection coil 200A wherein the negative turns bias is non-linear, and wherein the intermediate region Li is very small and the exit region Lx is very long. Specifically, more exit region end turns are disposed nearer to the portion of the exit region Lx that is proximate the entrance region, so that the characteristic G-200 A over its exit region has a steeper negative slope near the entrance end of its exit region Lx than near the exit end thereof, thereby to have a concave or "sunken in" shape. For a 120° color CRT with a 30 kV screen potential, coil 200A has an HSE of 5.14 mJ as compared to 5.5 mJ for coil 200, as compared to 7.07 mJ for prior art coil 300'.

In FIG. 11B, a linear negative bias turns distribution characteristic G-200 is shown for reference and characteristics G-200B and G-200C illustrate deflection coils 200B and 200C wherein the negative turns bias is non-linear, plotted against the left-hand vertical scale in turns. Illustrated against the right-hand vertical scale representing distance from the Z axis (in mm) are certain physical elements of a deflection yoke, specifically the deflection yoke core DYC of ferrite or other suitable magnetic material, and the horizontal deflection coil 200, 200B, 200C. The envelope of the CRT, which would be close to the horizontal coil (actually, the deflection yoke is assembled with the CRT so that the horizontal coil is closely adjacent the CRT envelope), is not shown.

Specifically, characteristic G-200B represents a deflection coil 200B wherein more exit region end turns are disposed towards the portion of the exit region that is nearer to the entrance region, so that the characteristic G-200A over its exit region has a steeper negative slope near the entrance end of its exit region than near the exit end thereof, thereby to have a concave or "sunken in" shape. This arrangement decreases the number of turns near the yoke exit which may effectively reduce the average diameter of the deflection yoke coils and shift the deflection center towards the yoke entrance, thereby tending to reduce the deflection angle required to deflect the electron beam to the screen edges and corners. Alternatively, characteristic G-200C represents a deflection coil 200C wherein more exit region end turns are disposed towards the portion of the exit region that is nearer to the yoke exit, so that the characteristic G-200C over its exit region has a shallower negative slope near the entrance end of its exit region than near the exit end thereof, thereby to have a convex or "bulged" shape.

In FIG. 11C, a linear negative bias turns distribution characteristic G-200 is again shown for reference and characteristic G-200D illustrates deflection coil 200D wherein the negative turns bias is non-linear and non-monotonic, plotted against the left-hand vertical scale in turns. Illustrated against the right-hand vertical scale representing distance from the Z axis (in mm) are deflection yoke core DYC and horizontal deflection coil 200D. The CRT envelope is not shown. Specifically, characteristic G-200D represents a deflection coil 200D wherein more end turns carrying current in the same direction as the entrance region end turns are disposed in the mid-portion of the exit region, so that the characteristic G-200A over its exit region has a negative slope near both the entrance end and the exit end of its exit region and has a positive slope over a middle (but not necessarily centered) portion of the exit region, thereby to have a "jagged" or "peaked" shape.

Deflection coils producing characteristics of shape like that of plots G-200 through G-200C are sometimes referred to as "single bias" coils and those producing characteristics of shape like that of plot 200D are sometimes referred to as "double bias" coils, because there are two regions of increasing cumulative turns count. Double bias coil arrangements as in deflection coil 200D may provide a longer coil entrance length, which tends to reduce the deflection angle required to reach the screen corners and/or to reduce the average diameter of the deflection yoke, thereby tending to reduce the HSE of the deflection yoke. Example coil parameter values include:

| Coil Type | HSE (mJ) | Entrance Z (mm) | Exit Z (mm) | Exit Radius (mm) | Coil Length (mm) | Deflection Angle |
|---|---|---|---|---|---|---|
| 200 | 10.12 | −69.2 | −4.43 | 100 | 65 | 135° |
| 200B | 9.33 | −69.2 | −4.43 | 100 | 65 | 133° |
| 200C | 10.08 | −69.2 | −4.43 | 97 | 65 | 135° |
| 200D | 8.4 | −88.2 | −12.33 | 97 | 76 | 132° |

Figure 12:
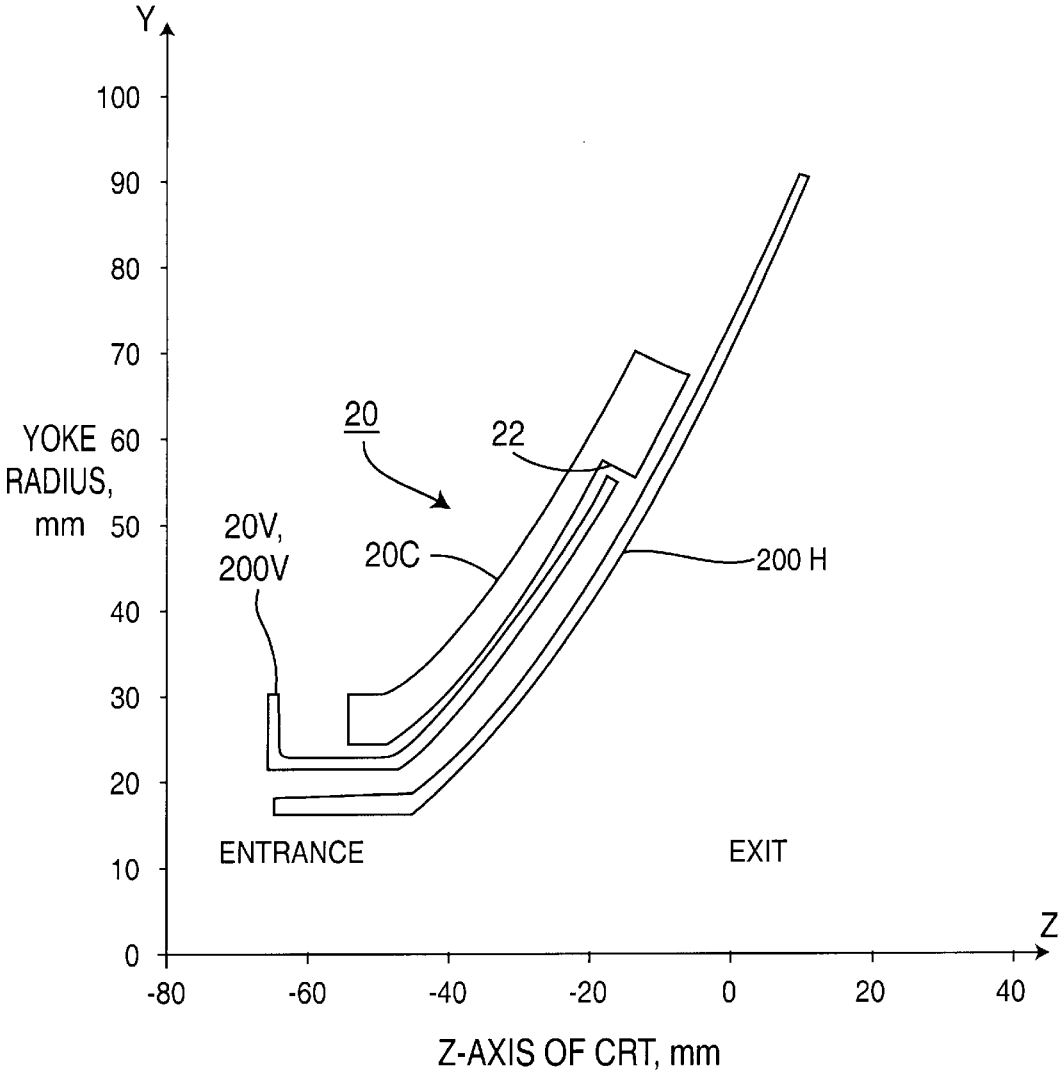
FIG. 12 is a graphical representation of a sectional view of a deflection yoke and its position relative to a CRT for a deflection yoke including the invention.

FIG. 12 is a graphical representation of a sectional view of a deflection yoke and its position relative to a CRT (not shown) for a deflection yoke 20 including the invention. Yoke 20 has a ferrite core 20C wherein the surface thereof adjacent the deflection coils and the CRT envelope is stepped to define a recess having a shoulder 22 between a thicker portion and a thinner portion, which may enhance correction of top-bottom (vertical) pincushion distortion. Vertical coil 20V is turned up at its entrance and is shortened at the exit end so as to be under the core 20C and to extend to shoulder 22, thereby allowing core 20C to be closer to the exit end of horizontal coil 200H, which has a negative bias non-constant turns distribution. Horizontal coil 200H extends beyond the end of core 20C at its exit end and at its entrance end. For a 120° color CRT with a 30 kV electron beam, for example, a deflection yoke 20 of substantially similar size to a conventional yoke that has an HSE value of 7.07 mJ, exhibits an HSE of 5.41 mJ, i.e. a beneficial reduction of about 23%.

Figure 13:
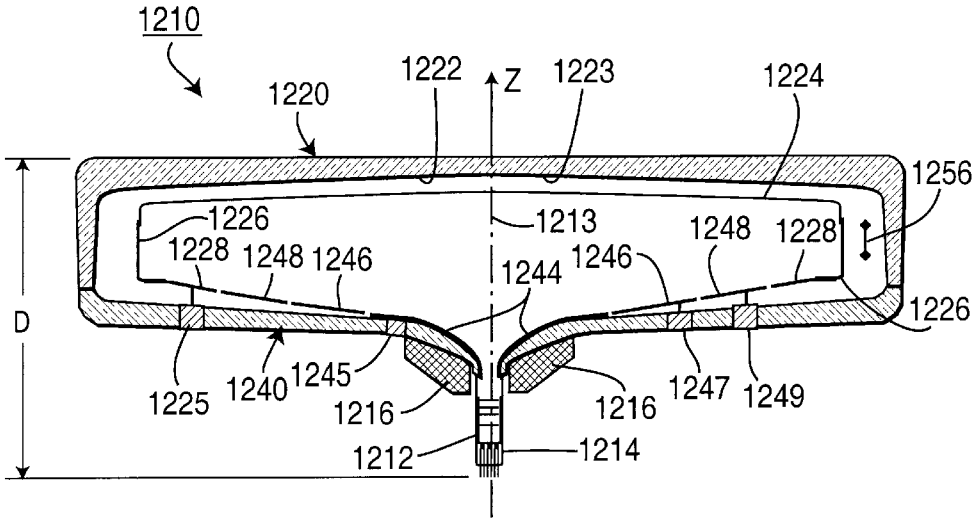
FIGS. 13 and 14 are cross-sectional diagrams illustrating alternative example embodiments providing appropriately positioned electrodes within a cathode ray tube.

FIG. 13 is a cross-sectional diagram of an alternative example cathode ray tube 1210 showing an alternative arrangement for appropriately positioning a set of electrodes 1244, 1246, 1248 mounted within the interior of funnel-shaped glass bulb 1240 to deflect an electron beam (not shown) to land on screen electrode 1222 and phosphors 1223, similarly to screen 22 and electrodes 44, 46, 48 described above. Electron gun 1212, neck 1214, faceplate 1220, phosphors 1223, shadow mask 1224, mask frame 1226, and funnel-shaped glass bulb 1240 are disposed symmetrically relative to centerline 1213, and may include a getter material 1256 in a convenient location in the space between glass bulb 1240 and one or more of metal electrodes 1246, 1248, mask frame 1226 and mask frame shield 1228, all of the foregoing being substantially as described above.

Stamped metal mask shield 1228 and stamped metal electrodes 1246, 1248 are formed as a set of mirror-image plates and/or loops of ascending dimension and are positioned symmetrically with respect to tube central axis 1213 with the smallest proximate neck 1214 and the largest proximate mask frame 1226 and faceplate 1220. Mask frame 1226 is a relatively rigid metal structure attached to the interior of faceplate 1220, such as by metal clips or by embedment in glass support features such as glass beads or lips on the interior surface of faceplate 1220, and provides support for mask shield 1228 and for electrodes 1246 and 1248 attached thereto Typically, two or more insulating supports 1252 (not visible) bridge the gap between mask shield 1228 and electrode 1248 for providing electrically insulating support therebetween to hold mask shield 1228 and electrode 1248 in a desired relative position. Similarly, two or more additional insulating supports 1252 (not visible) bridge the gap between electrode 1246 and electrode 1248 for providing electrically insulating support therebetween to hold electrode 1246 and 1248 in a desired relative position. Mask shield 1228 and electrodes 1246, 1248 are electrically isolated, unless it is desired that two or more of mask shield 1228 and electrodes 1246, 1248 be at the same bias potential.

In a typical tube 1210 having an about 81 cm (about 32-inch) diagonal faceplate 1220 in a 16:9 wide-format aspect ratio, depth D is about 28 cm (about 11 inches). Screen 1222, mask 1224, mask support 1226 and mask shield 1228 are biased to a potential of about 28–32 kV, and typically 30 kV, via high-voltage conductor 1225 (i.e. "button" 1225) penetrating glass bulb 1240. Coated neck region electrode 1244 is biased in a range of about 18–24 kV, typically 22 kV, applied via button 1245. High voltage electrode 1246 is biased to a potential higher than the screen bias potential in a range of about 30–35 kV, typically 35 kV, applied via button 1247, for increasing the electron-beam deflection provided by deflection yoke 1216. Electrode 1248 is biased to a potential less than the screen bias potential in a range of about 18–24 kV, typically 22 kV, applied via button 1249, for directing the electron beam in the peripheral region near the edges of faceplate 1220 towards faceplate 1220. Alternatively, bias potentials as described in relation to tube 10 may be utilized.

Figure 14:
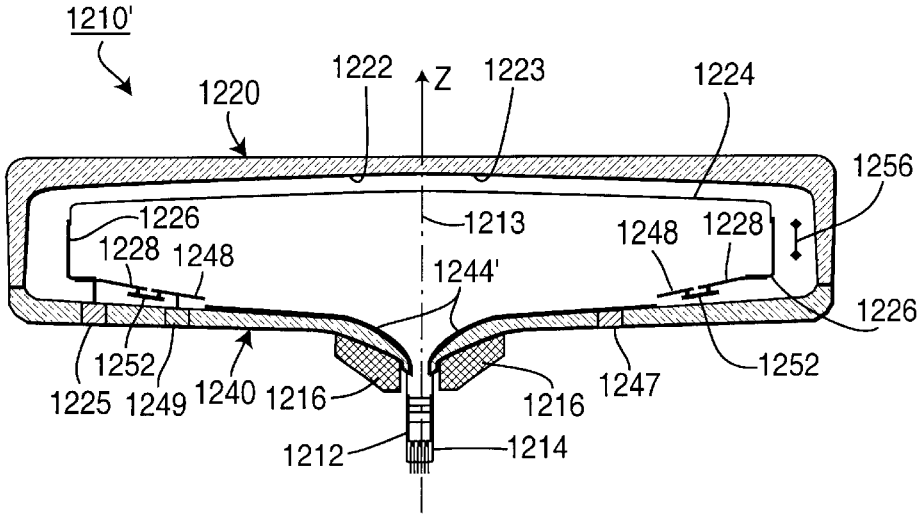

FIG. 14 is a cross-sectional diagram illustrating another alternative example arrangement of appropriately positioned electrodes 1244, 1248 within a cathode ray tube 1210'. Tube 1210' is like tube 1210 of FIG. 13 except that stamped metal electrode 1246 is eliminated and coated neck electrode 1244' extends to cover the portion of the interior surface of glass bulb 1240 that was behind and thus shielded by electrode 1246 in tube 1210. Visible therein is support 1252 which is typically a ceramic support fused or otherwise attached to mask shield 1228 and electrode 1240 for supporting same in desired relative positions.

Neck electrode 1244' is biased at the same potential as is screen electrode 1222 in tube 1210 and may extend to carry such bias potential applied via button 1245 to screen electrode 1222, mask 1224, mask frame 1226 and mask shield 1228, e.g., such as via a metal clip thereon or other connection. Electrode 1248 is biased via button 1249 in like manner to tube 1210. In any of the tubes 10, 1210, 1210' and so on, high voltage feedthrough buttons 25, 45, 47, 49, 1225, 1245, 1247, 1249 may be positioned to penetrate glass tube envelope 40, 1240 at any convenient location. Alternatively, bias potentials as described in relation to tube 10 may be utilized.

Figure 15A:
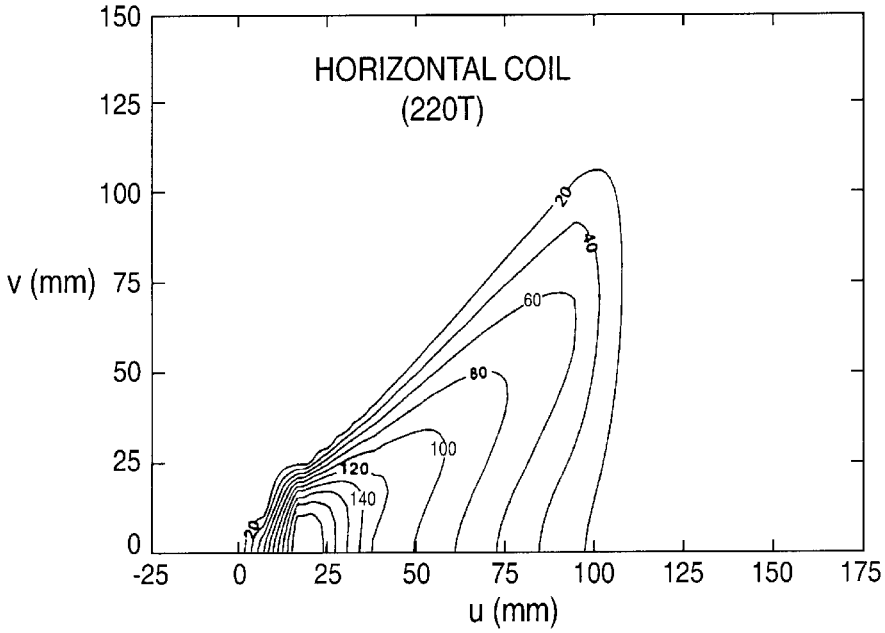
FIGS. 15A and 15B are computer-generated graphical representations of one quadrant of the horizontal and vertical deflection coils, respectively, of a deflection yoke according to the invention.
Figure 15B:
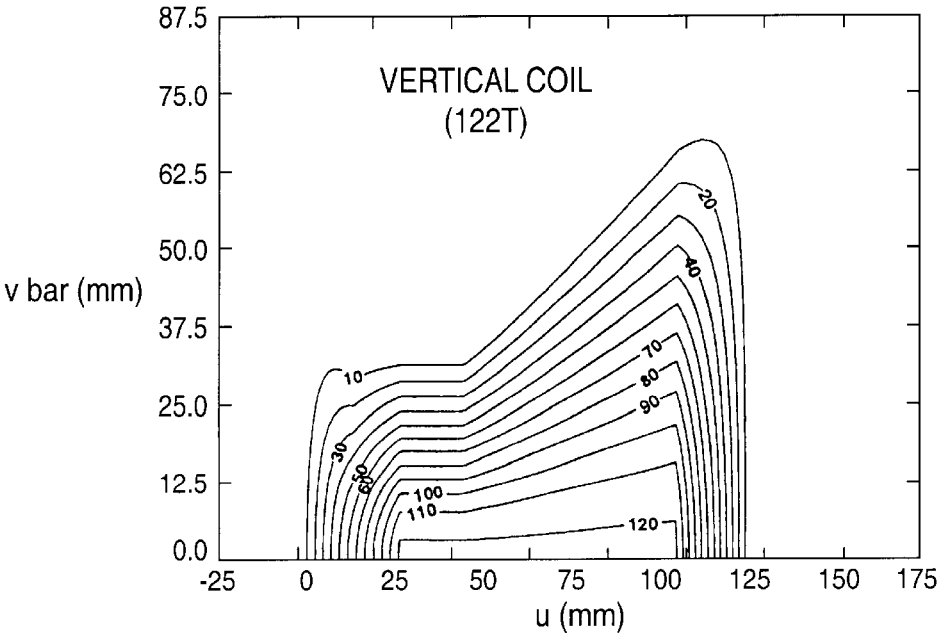

FIGS. 15A and 15B are computer-generated graphical representations of one quadrant of example horizontal and vertical deflection coils, respectively, of a deflection yoke according to the invention. The contours include numbers that indicate the number of the turn, wherein the first turn wound would be numbered "1" (if shown), the fortieth turn wound would be numbered "40" and so forth. The contours are analogous to the number of turns and are suggestive of the physical layout of the wires of each coil. The horizontal coil represented in FIG. 15A has 220 turns in a negative bias non-constant turns distribution and the vertical coil represented in FIG. 15B has 122 turns in a conventional constant turns distribution.

Figure 16A:
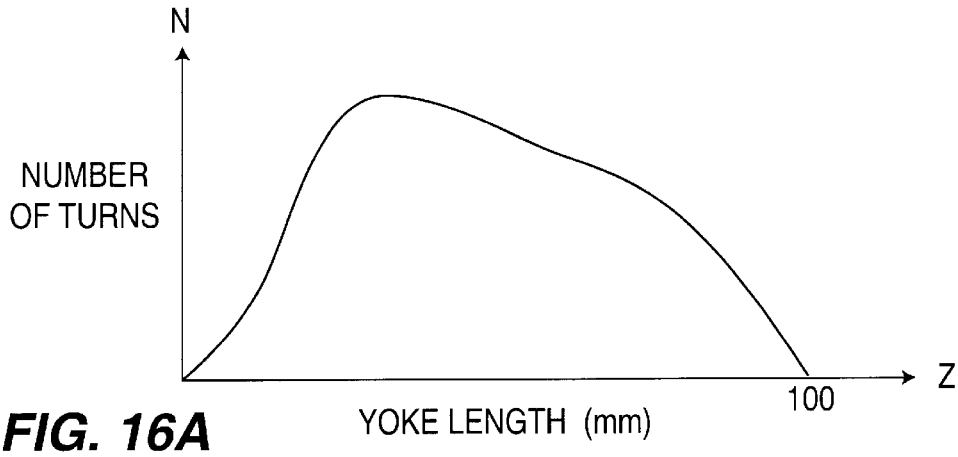
FIG. 16A shows a graphical representation of the cumulative number of turns of a horizontal deflection coil having a negative bias non-constant and non-linear turns distribution.
Figure 16B:
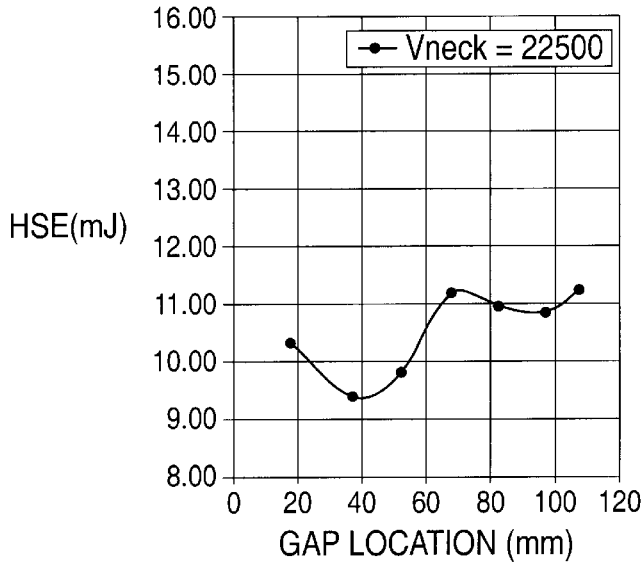
FIGS. 16B and 16C show graphical representations of parametric variation of HSE for the coil of FIG. 16A.
Figure 16C:
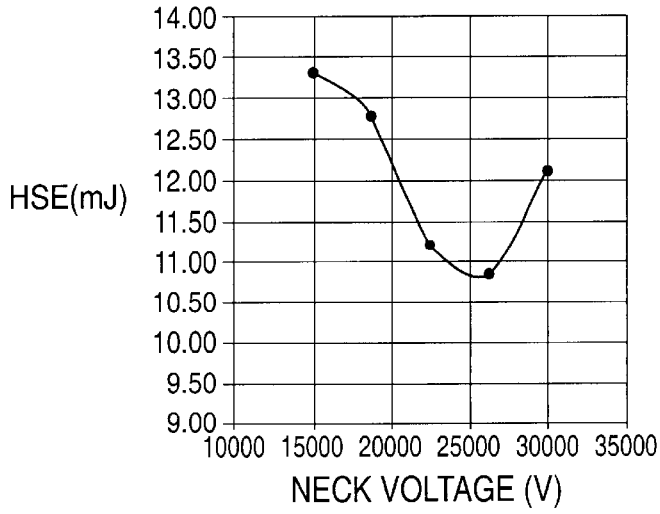

FIG. 16A shows a graphical representation of the cumulative number of turns of a horizontal deflection coil having a negative bias non-constant turns distribution, wherein the turns distribution is non-linear to produce a characteristic having a convex shape. FIGS. 16B and 16C show graphical representations of parametric variation of HSE for the coil of FIG. 16A wherein the coil is employed in a deflection yoke with a CRT of the sort shown in FIG. 1 or in FIG. 13. Specifically, FIG. 16B illustrates the parametric variation of HSE as a function of the location of the gap between electrodes 44 and 46 of CRT 10 or between electrodes 1244 and 1246 of CRT 1210 at a fixed bias potential (e.g., 22.5 kV) applied to electrode 44 or 1244. FIG. 16C illustrates parametric variation of HSE as a function of the bias potential applied to electrode 44 or 1244 for a particular location of the gap between electrodes 44 and 46 of CRT 10 or between electrodes 1244 and 1246 of CRT 1210. Because each parametric characteristic has a minimum point, it is generally desirable to select both the gap location and the bias potential for electrode 44, 1244 to reduce the value of HSE to a desired value.

Figure 17A:
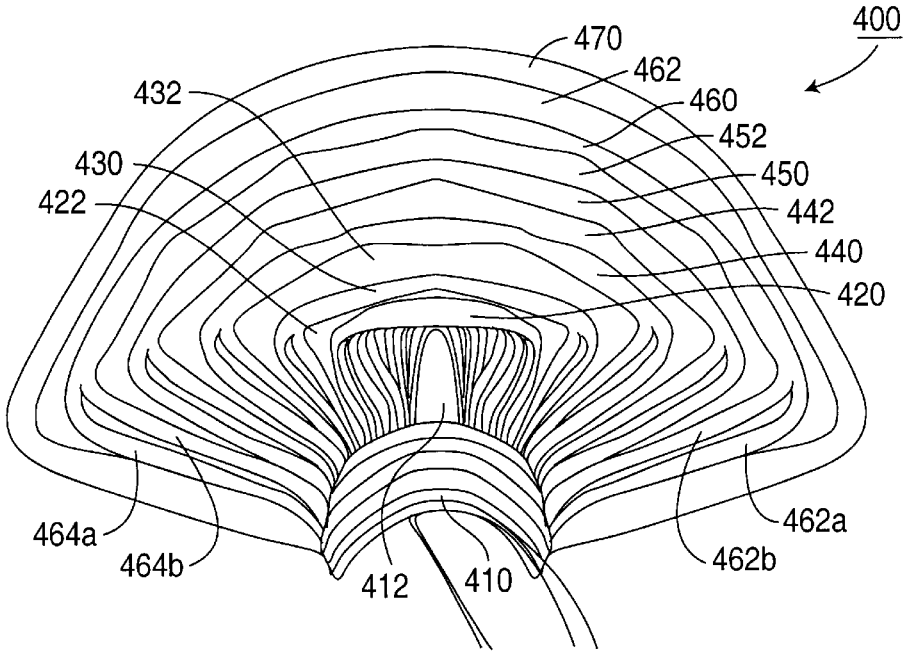
FIGS. 17A, 17B and 17C are rear, bottom and side views, respectively, of an example deflection coil according to the invention.
Figure 17B:
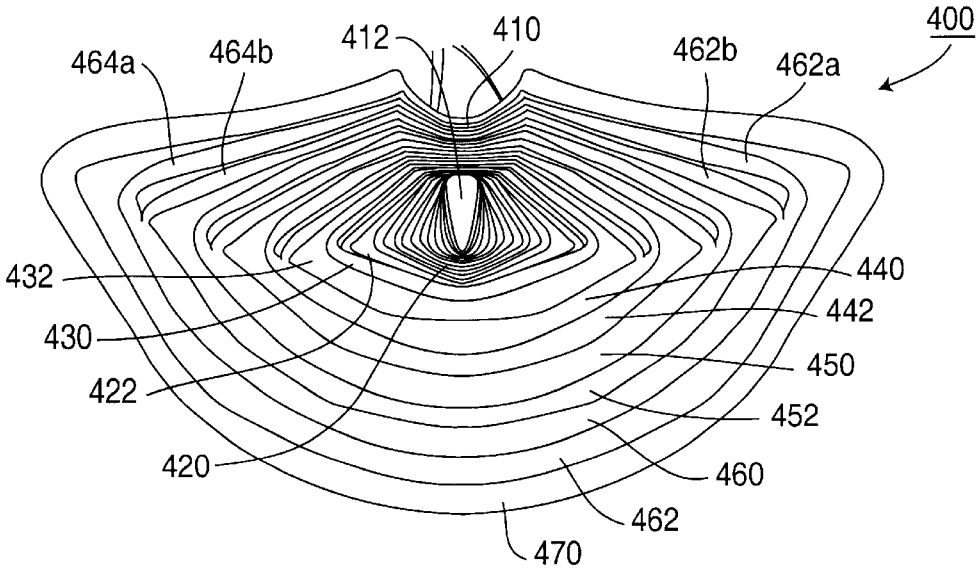
Figure 17C:
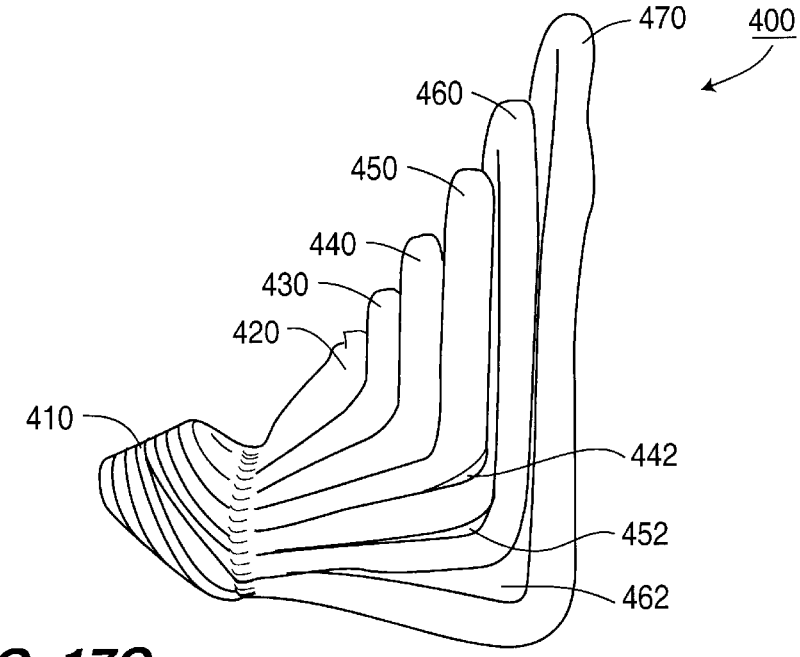
Figure 17D:
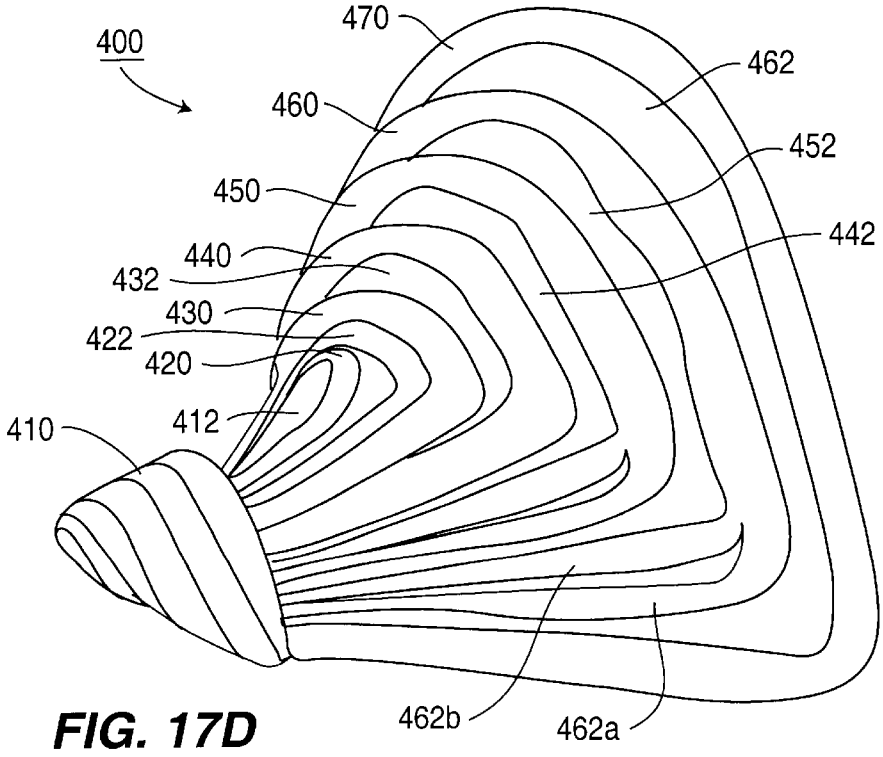
FIG. 17D is a perspective view thereof.

FIGS. 17A, 17B and 17C are a rear view (from the tube/neck/electron gun end), a bottom view (side facing the CRT envelope) and a side view, respectively, of an example deflection coil 400 according to the invention, and FIG. 17D is a perspective view thereof. Example deflection coil 400 has 151 turns built up in entrance region 410 and reaching a maximum cumulative number at the boundary of the entrance (gun end) and intermediate regions. Coil 400 has six transverse annular bridges or bundles 420–470 of transverse turns of about 21–31 turns each, with the bundle 470 of turns nearest the coil exit having about 16 turns. Specifically, the turns counts of bundles 420–470 are about 29 turns, 21 turns, 25 turns, 29 turns, 31 turns and 16 turns, respectively. The bundles 420–470 of turns are approximately evenly spaced in the Z direction to provide a nearly linear negative turns bias between the screen end of the yoke entrance region and the yoke exit.

Bundles of turns 420–470 of example deflection yoke 400 are relatively evenly spaced apart as side turns between the center and the sides of deflection coil 400 to provide a desired near-uniform field for a non-converging deflection yoke, with some third harmonic near the exit end of coil 400 for correcting top/bottom pincushion distortion in the raster. In addition, the side turns of bundles 430–460 are further divided (e.g., divided into two sub-groups of side turns 462*a* & 462*b*, and 464*a* & 464*b* for bundle 460, and into six sub-groups for bundle 420) for distributing the side turns to provide the desired third harmonic content of coil 400. The side turn bundles extend over angles of up to about 85–90° about the Z axis with respect to the Y-Z plane.

In general, a dimension, size, formulation, parameter, shape or other quantity or characteristic is "about" or "approximate"whether or not expressly stated to be such, and varies as by tolerances, conversion factors, rounding off, measurement error, and other factors known to those of skill in the art. The deflection coils described herein may be wound on a form having the shape of the CRT envelope (funnel) with which the coil is to conform, with pins positioned for defining the locations against and/or around which the wire is bent or positioned in placing the wire to form the desired coil.

While the present invention has been described in terms of the foregoing example embodiments, variations within the scope and spirit of the present invention as defined by the claims following will be apparent to those skilled in the art. For example, the horizontal deflection coils, the vertical deflection coils or both, may have non-constant turns distributions, and such non-constant turns distributions may be the same or may be different. In addition, the deflection yokes and deflection coils described are examples believed useful for reducing yoke HSE, may also have turns thereof physically arranged for providing correction for one or more of coma error, mis-convergence, pincushion and barrel distortion, astigmatism, north-south and/or east-west raster errors, harmonic correction, and the like. The deflection yoke herein may be used with CRTs for various applications including but not limited to black-and-white or color television (whether analog or digital or standard definition or high definition), video displays, monitors, graphic displays, computer displays, instruments and the like. Further, such CRTs may have tube necks and/or tube envelope funnels having a circular or elliptical or rectangular or other shape.

It is noted that while the central window or opening around which the maximum cumulative number of turns pass in the prior art deflection coils is generally large, the opening in a deflection coil according to the invention around which the maximum cumulative number of turns pass is generally small. The small opening may be decreased to leave essentially no window (i.e. the intermediate region length Li is essentially zero), although in a practical case the pin or pins or other portion of the winding form will leave some small opening.

Further, while the bias potential applied to the peripheral electrode 48 is preferably less than the screen potential when used in a CRT with a relatively wide screen and a wide angle deflection yoke according to the invention, it may be equal to screen potential, may be more or less than the bias potential of neck electrode 44 and may even be at zero or ground potential or may be negative.

Table I presents various benefits and features of various deflection yokes as described herein. Abbreviations indicate the type of yoke, i.e. "SC" for self-converged and "NC" for non-self-converged, and for each of the vertical and horizontal coils, whether the coil has a constant or uniform turns distribution or has a negative bias or non-constant (non-uniform) turns distribution. "Neg. Bias" indicated that the number of turns decreases from a relatively higher number at the end of the yoke entrance to a relatively lower number or zero at the yoke exit. Typically, self-converging type yokes are especially applicable and are typically utilized where the total yoke deflection angle is about 120° or less and non-self converging yoke are especially applicable and are typically utilized where the total deflection angle is greater than about 120°.

To use the Table I, select the deflection yoke type NC or SC of interest in the upper portion of the table and then select deflection coil types of interest using the column of the table in which are asterisks or other marks in the upper portion of the table. Then look down in the table in the column selected to determine which of the Benefits pertain to that deflection yoke arrangement as indicated by the asterisks or other marks in that column next to the Benefit. For example, information relating to a self-converging yoke having a negative turns bias horizontal coil and a constant turns bias vertical coil is given in the 6th column, whereas that for corresponding coil arrangements in a non-self-converging yoke is given in the 3rd column.

Table I lists various possible combinations of horizontal and vertical deflection coil types (constant turns or negative bias turns) that may provide certain benefits, e.g., reduced stored energy, reduced deflection angle, improved heat dissipation. Each of the yokes may be applied in a circular or rectangular CRT funnel shape. Any savings in stored energy attributable to the rectangular shape are typically additive to savings in stored energy attributable to coils with negative bias turns. The case where both the horizontal and vertical coils have constant turns is the prior art and is not presented.

TABLE I

Matrix of Coil Combinations for Yokes with Negative Turns Bias

| Coil | Turns | NC | | | SC | | | Potential Benefits |
|---|---|---|---|---|---|---|---|---|
| Horizontal | Constant | | * | | | * | | |
| | Neg. Bias | * | | * | * | | * | |
| Vertical | Constant | | | * | | | * | |
| | Neg. Bias | * | * | | * | * | | |
| | | * | | * | * | | * | 1. Reduces HSE. |
| | | * | * | * | * | * | * | 2. Reduces deflection angle. |
| | | * | * | * | * | * | * | 3. Spreads out exit end-turns to improve heat dissipation. |
| | | | * | | | * | | 4. Requires no change from conventional horizontal coil. |
| | | | | * | | | * | 5. Requires no change from conventional vertical coil. |
| | | * | * | | * | * | | 6. Reduces thickness of vertical coil enabling smaller-diameter ferrite core for lower HSE. |
| | | | | | * | | * | 7. Particularly well-suited for achieving winding harmonics for self-converging horizontal coils. |
| | | * | * | | * | * | | 8. Increases separation of H and V deflection centers for pincushion correction without increasing gun seal length and tube depth. |
| | | * | * | | | | | 9. Particularly well-suited for non-self-converging vertical coils. |
| | | * | * | | | | | 10. Amenable to auxiliary convergence correction means, e.g., minor-axis shunts or dynamic quadrupole coil for self-convergence. |

What is claimed is:

1. A magnetic deflection yoke comprising:

first and second deflection coils disposed for scanning an electron beam along first and second axes, each of said first and second deflection coils having an entrance region of increasing cumulative turns count, having an intermediate region of substantially constant cumulative turns count, and having an exit region of decreasing cumulative turns count adjacent a yoke exit, each of the regions having a respective length;

wherein the length of the exit region of at least one of said first and second deflection coils is substantially longer than the length of the entrance region and than the length of the intermediate region thereof, and wherein the cumulative turns count in the exit region of the at least one of said first and second deflection coils is equal to or less than eighty percent (80%) of the cumulative turns count in the intermediate region thereof over thirty-two percent (32%) or more of the combined length of the intermediate region and the exit region thereof; and a ferromagnetic core disposed for cooperating with said first and second deflection coils to form a deflection yoke.

2. The magnetic deflection yoke of claim 1 wherein the cumulative turns count in the exit region of the at least one of said first and second deflection coils is equal to or less than eighty percent (80%) of the cumulative turns count in the intermediate region thereof over forty percent (40%) or more of the combined length of the intermediate region and the exit region thereof.

3. The magnetic deflection yoke of claim 1 wherein the cumulative turns count in the exit region of the at least one of said first and second deflection coils is equal to or less than eighty percent (80%) of the cumulative turns count in the intermediate region thereof over fifty percent (50%) or more of the combined length of the intermediate region and the exit region thereof.

4. The magnetic deflection yoke of claim 1 wherein the cumulative turns count in the exit region of the at least one of said first and second deflection coils is also equal to or less than fifty percent (50%) of the cumulative turns count in the intermediate region thereof over twenty percent (20%) or more of the combined length of the intermediate region and the exit region thereof.

5. The magnetic deflection yoke of claim 1:

wherein the cumulative turns count of the at least one of said first and second deflection coils monotonically decreases in the exit region thereof in a direction from the intermediate region to the yoke exit thereof, or wherein the cumulative turns count of the at least one of said first and second deflection coils linearly decreases in the exit region thereof in a direction from the intermediate region to the yoke exit thereof, or wherein the cumulative turns count of the at least one of said first and second deflection coils non-linearly decreases in the exit region thereof in a direction from the intermediate region to the yoke exit thereof, or wherein the cumulative turns count of the at least one of said first and second deflection coils monotonically and non-linearly decreases in the exit region thereof in a direction from the intermediate region to the yoke exit thereof.

6. The magnetic deflection yoke of claim 1:

wherein the non-linear decrease of the cumulative turns count is at a greater rate proximate an end of the exit region near the intermediate region than at an end of the exit region near the yoke exit, or wherein the non-linear decrease of the cumulative turns count is at a lesser rate proximate an end of the exit region near the intermediate region than at an end of the exit region near the yoke exit, or wherein the non-linear decrease of the cumulative turns count includes first and second regions of decreasing cumulative turns count separated by a region of increasing cumulative turns count.

7. The magnetic deflection yoke of claim 1 in combination with a cathode ray tube comprising a tube envelope including a screen and an electron gun providing an electron beam impinging on the screen, wherein said magnetic deflection yoke is disposed proximate the tube envelope for scanning deflection of the electron beam produced by said electron gun on said screen.

8. The magnetic deflection yoke of claim 1:

wherein the at least one of said first and second deflection coils includes a horizontal deflection coil, or wherein the at least one of said first and second deflection coils includes a vertical deflection coil, or wherein the at least one of said first and second deflection coils includes both a horizontal deflection coil and a vertical deflection coil.

9. The magnetic deflection yoke of claim 1 wherein said magnetic deflection yoke is either a non-converging magnetic deflection yoke, a self-converging magnetic deflection yoke or a non-self converging magnetic deflection yoke.

10. The magnetic deflection yoke of claim 1 wherein said cumulative turns count includes a positive turns bias, a negative turns bias, or a positive turns bias and a negative turns bias, and/or forward and reverse turns.

11. The magnetic deflection yoke of claim 1:

wherein said ferromagnetic core is stepped to define a recess having a transverse shoulder between a thicker portion towards the yoke exit and a thinner portion proximate the entrance region, wherein the at least one of said first and second deflection coils extends substantially the length of said ferromagnetic core between the entrance region and the yoke exit, and wherein the other of said first and second deflection coils is disposed in the recess of said ferromagnetic core between the entrance region and the shoulder thereof.

12. A magnetic deflection yoke comprising:

first and second deflection coils disposed for scanning an electron beam along first and second axes, each of said first and second deflection coils having an entrance region of increasing cumulative turns count, having an intermediate region of substantially constant cumulative turns count, and having an exit region of decreasing cumulative turns count adjacent a yoke exit, each of the regions having a respective length;

wherein the length of the exit region of at least one of said first and second deflection coils is substantially longer than the length of the entrance region and than the length of the intermediate region thereof, and wherein the cumulative turns count in the exit region of the at least one of said first and second deflection coils is equal to or less than fifty percent (50%) of the cumulative turns count in the intermediate region thereof over twenty percent (20%) or more of the combined length of the intermediate region and the exit region thereof; and a magnetic core disposed for cooperating with said first and second deflection coils to form a deflection yoke.

13. A magnetic deflection yoke for a cathode ray tube having a funnel-shaped tube envelope, said magnetic deflection yoke having an entrance region, an intermediate region shorter than the entrance region and the exit region, and an exit region at least twice as long as the entrance region, said magnetic deflection yoke comprising:

a horizontal deflection coil formed to conform substantially to the funnel-shaped tube envelope and having N turns disposed in the entrance and exit regions, wherein the N turns in the exit region are disposed in at least four transverse spaced apart annular bundles;

a vertical deflection coil formed to conform substantially to the funnel-shaped tube envelope; and a magnetic core disposed for cooperating with said horizontal and vertical deflection coils to form a deflection yoke.

14. A magnetic deflection yoke for a cathode ray tube having a funnel-shaped tube envelope, said magnetic deflection yoke having an entrance region, an intermediate region shorter than either or both of the entrance region and an exit region, wherein the exit region is at least twice as long as the entrance region, said magnetic deflection yoke comprising:

a horizontal deflection coil formed to conform substantially to the funnel-shaped tube envelope and having N turns disposed in the entrance and exit regions, each of said N turns having opposing transverse entrance and exit end turn portions and having opposing side turn portions, wherein the entrance end turn portions of the N turns are disposed transversely in the entrance region, and wherein the exit end turn portions of the N turns in the exit region are disposed in a number M of transverse spaced-apart annular bundles, wherein the number M is between four and the number N of turns;

a vertical deflection coil formed to conform substantially to the funnel-shaped tube envelope; and a magnetic core disposed for cooperating with said horizontal deflection coil and said vertical deflection coil to form a deflection yoke.

15. The magnetic deflection yoke of claim 14 wherein the opposing side turn portions of said N turns are disposed symmetrically with respect to a direction from the entrance region to the exit region between the entrance region and the at least four transverse spaced-apart annular bundles.

16. The magnetic deflection yoke of claim 14 wherein the number M of transverse spaced-apart annular bundles in the exit region is four, five, or six.

17. The magnetic deflection yoke of claim 14 in combination with a cathode ray tube including a faceplate and a tube neck having an electron source therein, and further including a funnel-shaped tube envelope joining said faceplate and said tube neck, wherein said deflection yoke is disposed proximate said tube envelope for deflecting electrons produced by said electron source.

* * * * *